US009414980B2

(12) United States Patent
Kume et al.

(10) Patent No.: US 9,414,980 B2
(45) Date of Patent: Aug. 16, 2016

(54) BED, AND COMBINING METHOD AND SEPARATING METHOD OF BED

(75) Inventors: Yohei Kume, Osaka (JP); Toshihide Ueda, Osaka (JP); Shohei Tsukada, Osaka (JP); Hideo Kawakami, Osaka (JP); Tohru Nakamura, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 1187 days.

(21) Appl. No.: 13/393,932

(22) PCT Filed: Jun. 7, 2011

(86) PCT No.: PCT/JP2011/003186

§ 371 (c)(1),
(2), (4) Date: Mar. 2, 2012

(87) PCT Pub. No.: WO2011/155177

PCT Pub. Date: Dec. 15, 2011

(65) Prior Publication Data

US 2012/0153687 A1 Jun. 21, 2012

(30) Foreign Application Priority Data

Jun. 8, 2010 (JP) ..... 2010-130708

(51) Int. Cl.
*A47B 71/00* (2006.01)
*A61G 7/16* (2006.01)
(Continued)

(52) U.S. Cl.
CPC ..... *A61G 7/16* (2013.01); *A61G 5/1067* (2013.01); *A61G 7/015* (2013.01); *A61G 3/08* (2013.01);
(Continued)

(58) Field of Classification Search
CPC ..... A61G 7/16; A61G 7/15; A61G 5/1067; A61G 2007/165; A61G 5/006; A61G 3/08; A61G 3/0808; A61G 7/018; Y10T 29/4978; Y10T 29/49815; Y10T 29/49826
See application file for complete search history.

(56) References Cited

U.S. PATENT DOCUMENTS 2,607,929 A * 8/1952 Balluff ..... A61G 5/006 296/20
3,138,805 A * 6/1964 Piazza ..... A61G 5/00 297/411.34
(Continued)

FOREIGN PATENT DOCUMENTS

CN 200994875 12/2007
DE 41 30 610 3/1993
(Continued)

OTHER PUBLICATIONS

English translation of the International Preliminary Report on Patentability issued Jan. 15, 2013 in International (PCT) Application No. PCT/JP2011/003186.
(Continued)

*Primary Examiner* — David E Sosnowski
*Assistant Examiner* — Morgan McClure
(74) *Attorney, Agent, or Firm* — Wenderoth, Lind & Ponack, L.L.P.

(57) ABSTRACT

A bed is composed of combining a wheelchair and a bed main body portion. The wheelchair has a seating bottom portion composed of bendably coupling a plurality of divided members, a chair bottom support member supporting the seating bottom portion, a chair base portion for fixing the chair bottom support member, and traveling wheels supporting the chair base portion. The bed main body portion has a bed bottom portion composed of bendably coupling a plurality of divided members, a bed bottom support member supporting the bed bottom portion, and a bed base portion for fixing the bed bottom support member. In a case where the wheelchair and the bed main body portion are combined, a support member supporting the seating bottom portion is switched from the chair bottom support member to the bed bottom support member.

18 Claims, 17 Drawing Sheets

(51) Int. Cl.

| | |
|---|---|
| ***A61G 5/10*** | (2006.01) |
| ***A61G 7/015*** | (2006.01) |
| *A61G 7/018* | (2006.01) |
| *A61G 3/08* | (2006.01) |

(52) U.S. Cl.
CPC ..... *A61G 7/018* (2013.01); *A61G 2007/165* (2013.01); *Y10T 29/4978* (2015.01); *Y10T 29/49815* (2015.01); *Y10T 29/49826* (2015.01)

(56) References Cited

U.S. PATENT DOCUMENTS

| | | | | |
|---|---|---|---|---|
| 4,240,169 | A * | 12/1980 | Roos | A61G 3/06 297/DIG. 4 |
| 4,377,162 | A * | 3/1983 | Staver | A61M 16/0666 128/200.28 |
| 4,987,620 | A * | 1/1991 | Sharon | A61G 5/006 5/600 |
| 5,555,582 | A * | 9/1996 | Jerideau | A61G 5/006 5/600 |
| 6,138,302 | A * | 10/2000 | Sashin | A61B 6/0421 5/600 |
| 6,272,702 | B1 * | 8/2001 | Uchida | A61G 5/006 5/600 |
| 6,694,167 | B1 * | 2/2004 | Ferre | A61B 5/06 600/424 |
| 7,073,508 | B2 * | 7/2006 | Moyers | A61N 5/1049 128/857 |
| 8,157,287 | B1 * | 4/2012 | Cleveland | A61G 5/006 280/30 |
| 8,418,288 | B2 * | 4/2013 | Miller | A61N 5/1049 5/600 |
| 2001/0029629 | A1 * | 10/2001 | Tsuji | A61G 5/006 5/618 |
| 2006/0085919 | A1 * | 4/2006 | Kramer | A47C 7/022 5/713 |
| 2006/0117479 | A1 | 6/2006 | Kawakami et al. | |
| 2006/0191073 | A1 * | 8/2006 | Honda | A61G 5/006 5/600 |
| 2006/0236458 | A1 * | 10/2006 | Barthelt | A61G 7/053 5/613 |
| 2006/0249163 | A1 * | 11/2006 | Wakhloo | A61F 5/055 128/869 |
| 2006/0253985 | A1 * | 11/2006 | Skripps | A61G 13/04 5/622 |
| 2009/0308400 | A1 * | 12/2009 | Wilson | A61F 5/3769 128/845 |
| 2010/0078033 | A1 * | 4/2010 | Aikman | A61G 7/065 128/845 |
| 2011/0030138 | A1 * | 2/2011 | Kawakami | A61G 5/006 5/2.1 |
| 2011/0196562 | A1 * | 8/2011 | Kume | A61G 5/006 701/23 |
| 2012/0159705 | A1 * | 6/2012 | Tsukada | A61G 5/006 5/2.1 |
| 2012/0169093 | A1 * | 7/2012 | Kume | A61G 5/04 297/118 |
| 2013/0109992 | A1 * | 5/2013 | Guyette | A61M 16/06 600/532 |
| 2014/0115786 | A1 * | 5/2014 | Wilson | A61B 19/203 5/622 |
| 2014/0366889 | A1 * | 12/2014 | Riley | A61F 9/045 128/845 |
| 2015/0045676 | A1 * | 2/2015 | Dawson | A61G 13/121 600/476 |

FOREIGN PATENT DOCUMENTS

| | | | |
|---|---|---|---|
| EP | 1 147 757 | 10/2001 | |
| JP | 60-142852 | 7/1985 | |
| JP | 5-51330 | 7/1993 | |
| JP | 5-176957 | 7/1993 | |
| JP | 05-176959 | 7/1993 | |
| JP | 2002-58709 | 2/2002 | |
| JP | 2004-73673 | 3/2004 | |
| JP | 2009-268789 | 11/2009 | |
| JP | 5-51330 | * 7/2013 | A61G 7/00 |
| WO | 98/44889 | 10/1998 | |

OTHER PUBLICATIONS

Chinese Office Action and Search Report mailed Nov. 26, 2012 in Chinese Patent Application No. 201180003705.3.

International Search Report issued Aug. 16, 2011 in International (PCT) Application No. PCT/JP2011/003186.

Extended European Search Report issued Sep. 14, 2015 in corresponding European Application No. 11792136.1.

* cited by examiner

BED, AND COMBINING METHOD AND SEPARATING METHOD OF BED

TECHNICAL FIELD

The present invention relates to a bed in which a part thereof can be separated as a wheelchair, and a combining method and a separating method of the bed.

BACKGROUND ART

In a hospital or a nursing care facility, for example, a patient, a care-receiver, or the like (hereinafter, abbreviated as the care-receiver) is required to move to other places from a state where the care-receiver lies on a bed in a hospital room many times a day. At this time, transferring of the care-receiver from the bed to a wheelchair is usually manually performed by a nurse, a caregiver, or the like (hereinafter, abbreviated as the caregiver). By such transferring, the caregiver bears a physical burden.

In order to reduce the physical burden on the caregiver by the transferring of the care-receiver, a bed in which a part of the bed is separated therefrom so as to be utilized as a wheelchair is proposed.

FIG. 12 shows a conventional bed 1. A bed surface of the bed 1 is composed of three plates of a side bed plate 2, a center bed plate 3, and a side bed plate 4. In order to compose the bed surface, there is a need for moving the center bed plate 3 of a platform truck 5 to a space 3*a* between the side bed plate 2 and the side bed plate 4. A caregiver brings up the side bed plate 4 to an upper side of a bed main body 6 taking a rotation mechanism 7 as a rotation center.

The caregiver moves the center bed plate 3 to the space 3*a* in a state where the side bed plate 4 is brought up to the upper side of the bed main body 6. By returning the side bed plate 4 to an original position after moving the platform truck 5 to the space 3*a*, the bed surface of the bed 1 is composed.

The platform truck 5 separated from the bed 1 can also be used as a wheelchair. In that case, the center bed plate 3 serves as a seating bottom of the wheelchair.

FIG. 13 is a side view of the platform truck 5. The platform truck 5 has a chair posture change mechanism in which a leg portion 3*c* is inclined in conjunction with an inclination of a back surface portion 3*b* in order to simply change the center bed plate 3 from a flat posture to a seating posture. When the back surface portion 3*b* is lifted upward until the back surface portion 3*b* becomes substantially vertical, the leg portion 3*c* is lowered downward via a first link 8*a* and a second link 8*b*. That is, only by lifting the back surface portion 3*b*, the leg portion 3*c* is lowered downward, and the flat posture is changed to the seating posture. Therefore, the caregiver can simply perform posture change of the wheelchair (for example, refer to Patent Literature 1).

CITATION LIST

Patent Literature

[Patent Literature 1] Japanese Unexamined Utility Model Publication No. 5-51330

TECHNICAL PROBLEM

A bed for nursing care requires a flat posture in which a bed surface is flat, a back lifting posture in which a back part of the bed surface is lifted, and a knee lifting posture in which a knee part of the bed surface is lifted. In a conventional bed 1, a bed surface can be composed of a side bed plate 2, a center bed plate 3, and a side bed plate 4 in the flat posture. However, the conventional bed 1 has such a construction that parts of the side bed plate 2 and the side bed plate 4 of the conventional bed 1 cannot be lifted. Therefore, in the conventional bed 1, the back lifting posture or the knee lifting posture cannot be composed of the entire bed surface, but the back lifting or the knee lifting is performed only by the center bed plate 3. That is, in the conventional bed 1, the back lifting posture or the knee lifting posture as well as a general nursing care bed cannot be composed.

SUMMARY OF INVENTION

The present invention is to solve such a problem, and an object thereof is to provide a bed in which posture change can be performed to form the flat posture, the back lifting posture, and the knee lifting posture as well as the general nursing care bed when a wheelchair is combined with the bed, and a combining method and a separating method of the bed.

Solution to Problem

In order to achieve the above object, the present invention is configured as below.

In order to achieve the above object, a bed of the present invention, comprises: a support switching mechanism, the bed being composed of separably combining a wheelchair and a bed main body portion, the wheelchair comprising:

a seating bottom portion composed of bendably coupling a plurality of divided members to each other; and a chair bottom support member supporting the seating bottom portion, the bed main body portion comprising:

a bed bottom portion composed of bendably coupling a plurality of divided members to each other; and a bed bottom support member supporting the bed bottom portion, the support switching mechanism switching a support member of the seating bottom portion of the wheelchair between the chair bottom support member and the bed bottom support member.

Further, in order to achieve the object, a combining method of a bed of the present invention comprises a support switching mechanism, the combining method for separably combining a wheelchair and a bed main body portion, wherein the wheelchair comprises: a seating bottom portion composed of bendably coupling a plurality of divided members to each other; and a chair bottom support member supporting the seating bottom portion, and the bed main body portion comprises: a bed bottom portion composed of bendably coupling a plurality of divided members to each other; and a bed bottom support member supporting the bed bottom portion, the combining method comprising: switching a support member supporting the seating bottom portion of the wheelchair from the chair bottom support member to the bed bottom support member by the support switching mechanism in a case where the wheelchair and the bed main body portion are combined.

Furthermore, in order to achieve the object, a separating method of a bed of the present invention combinably separates a wheelchair and a bed main body portion, wherein the wheelchair comprises: a seating bottom portion composed of bendably coupling a plurality of divided members to each other; and a chair bottom support member supporting the seating bottom portion, and the bed main body portion comprises: a bed bottom portion composed of bendably coupling a plurality of divided members to each other; and a bed bottom support member supporting the bed bottom portion, the separating method comprising: switching a support member supporting the seating bottom portion of the wheelchair from the bed bottom support member to the chair bottom support member in a case where the wheelchair and the bed main body portion are separated.

Advantageous Effects of Invention

In the present invention, when the wheelchair is combined with the bed, the seating bottom portion of the wheelchair is supported by the bed bottom support member. Thus, by the bed bottom support member, the seating bottom portion of the wheelchair and the bed bottom portion of the bed main body portion can integrally perform the posture change. Therefore, according to the present invention, the bed in which the posture change can be performed as well as a general nursing care bed, and the combining method and the separating method of the bed can be provided.

BRIEF DESCRIPTION OF DRAWINGS

These and other aspects and features of the present invention will become clear from the following description taken in conjunction with the preferred embodiments thereof with reference to the accompanying drawings, in which.

DESCRIPTION OF EMBODIMENTS

Figure 1A:
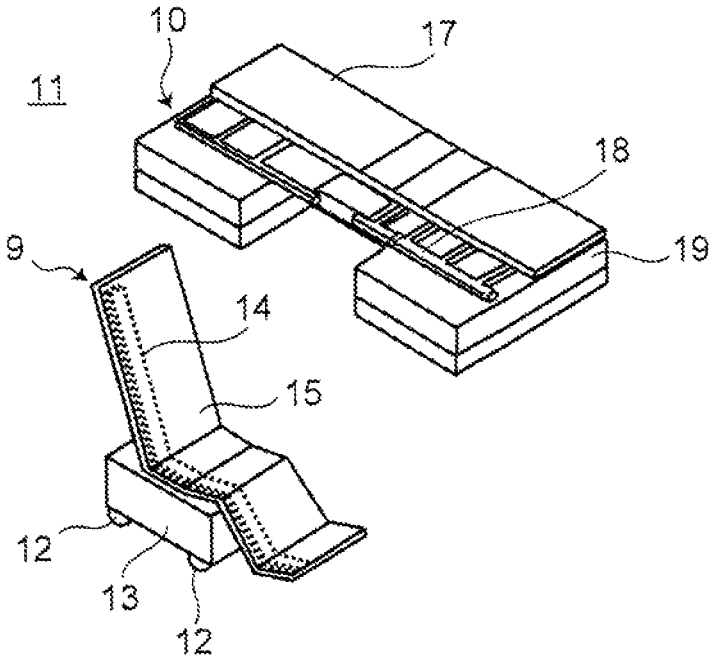
FIG. 1A is a schematic perspective view at the time of separation of a bed in a first embodiment of the present invention.

Hereinafter, embodiments of the present invention will be described with reference to the drawings. It should be noted that the identical constituent elements will be given the identical reference numerals, and description thereof will sometimes be omitted. For easy understanding, the figures are schematic focusing on the constituent elements.

First Embodiment

Figure 1B:
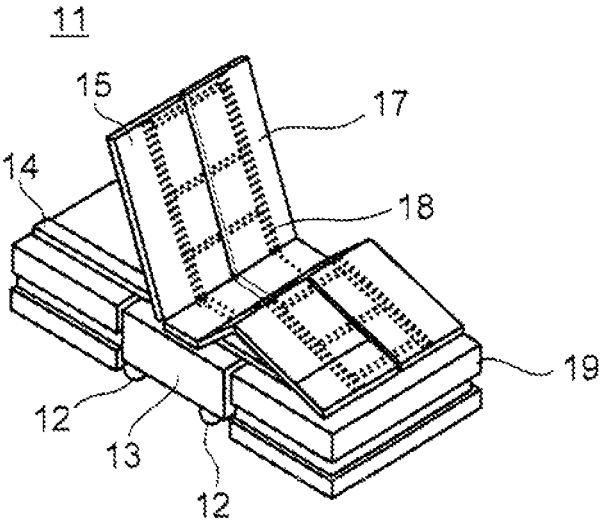
FIG. 1B is a schematic perspective view at the time of combination of the bed in the first embodiment of the present invention.

FIGS. 1A and 1B are schematic perspective views of a bed 11 in a first embodiment of the present invention. The bed 11 of the first embodiment is composed of combining a separable wheelchair 9 and a bed main body portion 10. FIG. 1A is a schematic perspective view of the bed 11 when the wheelchair 9 and the bed main body portion 10 are separated. FIG. 1B is a schematic perspective view of the bed 11 when the wheelchair 9 and the bed main body portion 10 are combined.

The bed 11 has a function of an electric nursing care bed whose posture is changed by electric drive sections, for example. The wheelchair 9 separated from the bed main body portion 10 has a function of a manual reclining wheelchair in which posture change is manually performed.

As shown in FIG. 1A, the wheelchair 9 is composed of a seating bottom portion 15, a chair bottom support member (chair guide member) 14, a chair base portion 13, and traveling wheels 12.

The seating bottom portion 15 is composed of bendably coupling a plurality of plate shape chair bottom members (such as five chair bottom members 15*a*, 15*b*, 15*c*, 15*d*, 15*e*) at coupling parts, and they serve as parts to be respectively brought into contact with a body of a patient, a care-receiver, or the like (hereinafter, abbreviated as the care-receiver).

In the chair bottom support member 14, a plurality of chair bottom support members 14*a*, 14*c*, 14*d*, 14*e* form a chair posture change mechanism 114 and support the seating bottom portion 15 so as to perform the posture change.

The chair base portion 13 supports the chair bottom support member 14 while allowing a bending action of the chair bottom support member 14.

At least a pair of traveling wheels 12 is provided, and in this embodiment, four traveling wheels are rotatably provided on a lower part of the chair base portion 13. The traveling wheels 12 movably support the chair base portion 13 and are capable of traveling on a ground (or an installment surface of the wheelchair 9 and the bed main body portion 10) 44 along the horizontal direction, for example.

In the wheelchair 9, when the posture change is performed by the chair bottom support member 14, a posture of the seating bottom portion 15 is changed in accordance with the posture change of the chair bottom support member 14. In the first embodiment, the plate shape chair bottom members 15*a*, 15*b*, 15*c*, 15*d*, 15*e* composing the seating bottom portion 15 of the wheelchair 9 are freely bent at the coupling parts. Therefore, the seating bottom portion 15 cannot maintain a fixed posture. The seating bottom portion 15 is supported by the chair bottom support member 14 serving as the posture change mechanism 114 of the wheelchair 9. That is, in the first embodiment, the seating bottom portion 15 performs posture maintenance or the posture change integrally with a posture of the chair bottom support member 14.

Meanwhile, as shown in FIG. 1B, the bed main body portion 10 is composed of a bed bottom portion 17, a bed bottom support member (bed bottom guide member) 18, and a bed base portion 19.

The bed bottom portion 17 is composed of bendably coupling a plurality of plate shape bed bottom members (such as four bed bottom members 17*a*, 17*b*, 17*c*, 17*d*) at coupling parts, and those members serve as parts to be respectively brought into contact with the body of the care-receiver.

In the bed bottom support member 18, a plurality of bed bottom support members 18*a*, 18*c*, 18*d* compose a bed posture change mechanism 119, and support the bed bottom portion 17 so as to be able to perform the posture change.

The bed base portion 19 supports the bed bottom support member 18 while allowing a bending action of this bed bottom support member 18. A part corresponding to a recess portion 28 serving as an intermediate part of the bed base portion 19 and as a combination area is recessed in the width direction, so that the chair base portion 13 of the wheelchair 9 is insertable thereinto.

In this embodiment, four traveling wheels 25 are respectively rotatably provided on the front and rear sides of a lower part of the bed base portion 19. The traveling wheels 25 movably support the bed base portion 19 and are capable of traveling on the ground (or the installment surface of the wheelchair 9 and the bed main body portion 10) 44. However, in the case where there is no need for moving the bed main body portion 10, the traveling wheels 25 are not necessarily provided.

In the first embodiment, it is so constructed that the bed bottom members 17*a*, 17*b*, 17*c*, 17*d* composing the bed bottom portion 17 of the bed main body portion 10 are freely bent at the coupling parts. Therefore, the bed bottom portion 17 cannot maintain a fixed shape. Thus, the bed bottom portion 17 performs the posture maintenance or the posture change integrally with a posture of the bed bottom support member 18.

The chair base portion 13 of the wheelchair 9 is moved in the width direction to and positioned in the recess portion 28 serving as the combination area provided on the side of the bed waist bottom member 17*b* between the bed back bottom support member 18*a* and the bed knee bottom support member 18*c*. By this positioning, the wheelchair 9 and the bed main body portion 10 can be combined. In the first embodiment, in the case where the wheelchair 9 and the bed main body portion 10 are combined in such a way, a member supporting the seating bottom portion 15 is switched from the chair bottom support member 14 to the bed bottom support member 18 (that is, the seating bottom portion 15 is supported only by the bed bottom support member 18 instead of the chair bottom support member 14). An action of switching the member supporting the seating bottom portion 15 from the chair bottom support member 14 to the bed bottom support member 18 is performed by a support switching mechanism. The support switching mechanism is composed of an arrangement relationship between the chair bottom support member 14 and the bed bottom support member 18, and an elevating section 27. In the bed 11, by switching the support member supporting the seating bottom portion 15 by this support switching mechanism, when the posture change is performed by the bed bottom support member 18, the bed bottom portion 17 and the seating bottom portion 15 integrally perform the posture change.

At this time, the chair bottom support member 14 is in a flat posture as shown in FIG. 1B but substantially in contact with the bed main body portion 10. Thus, the chair bottom support member 14 does not cause a disturbance in terms of structure.

That is, in the case where by moving the chair base portion 13 of the wheelchair 9 in the width direction and drawing out from the recess portion 28 serving as the combination area, the wheelchair 9 is separated from the bed main body portion 10, the seating bottom portion 15 of the wheelchair 9 is supported only by the chair bottom support member 14 serving as the chair posture change mechanism 114 (that is, the seating bottom portion 15 is supported only by the chair bottom support member 14 instead of the bed bottom support member 18), and the posture change of the seating bottom portion 15 of the wheelchair 9 is performed by the chair bottom support member 14.

Conversely, in the case where the wheelchair 9 and the bed main body portion 10 are combined, a posture change mechanism of the seating bottom portion 15 is switched from the posture change mechanism 114 having the chair bottom support member 14 to the posture change mechanism 119 having the bed bottom support member 18 by the support switching mechanism (that is, the seating bottom portion 15 is supported only by the bed bottom support member 18 instead of the chair bottom support member 14), and regarding the seating bottom portion 15 and the bed bottom portion 17, the posture change of the seating bottom portion 15 of the wheelchair 9 and the posture change of the bed bottom portion 17 of the bed main body portion 10 are performed by the bed bottom support member 18 serving as the bed posture change mechanism 119.

In such a way, by switching the posture change mechanism of the seating bottom portion 15 by the support switching mechanism between the time of separation and the time of combination of the bed 11, the posture of the seating bottom portion 15 can be set to a seating posture (a posture in which the care-receiver is seated) as shown in FIG. 1A at the time of the separation, and the postures of the seating bottom portion 15 and the bed bottom portion 17 can be set to a back lifting posture and a knee lifting posture as shown in FIG. 1B at the time of the combination. Here, the back lifting posture indicates a state where the seating bottom portion 15 and the bed bottom portion 17 are inclined in such a manner that a back of the care-receiver supported by the seating bottom portion 15 and the bed bottom portion 17 becomes slightly rearward oblique relative to the vertical direction. The knee lifting posture indicates a state where the seating bottom portion 15 and the bed bottom portion 17 are bent into an inverted V shape in such a manner that knees of the care-receiver supported by the seating bottom portion 15 and the bed bottom portion 17 are bent into an inverted V shape. Therefore, the bed 11 in which a part of the constituent thereof is the wheelchair 9 does not require a specific control or a power source on the side of the wheelchair 9 but obtains the functions of both the reclining wheelchair and the nursing care bed. That is, even in the bed 11 in which a part of the constituent thereof is the wheelchair 9, the knee lifting posture or the back lifting posture which is necessary as the nursing care bed can be composed. In the separated wheelchair 9, a posture of a back surface part of the seating bottom portion 15 can be changed as a general wheelchair.

Further, at the time of the combination of the wheelchair 9 and the bed main body portion 10, the seating bottom portion 15 and the bed bottom portion 17 are supported by the bed bottom support member 18. Thus, the seating bottom portion 15 and the bed bottom portion 17 integrally perform the posture change.

Next, details of the wheelchair 9 and the bed main body portion 10 composing the bed 11 will be described.

Figure 2A:
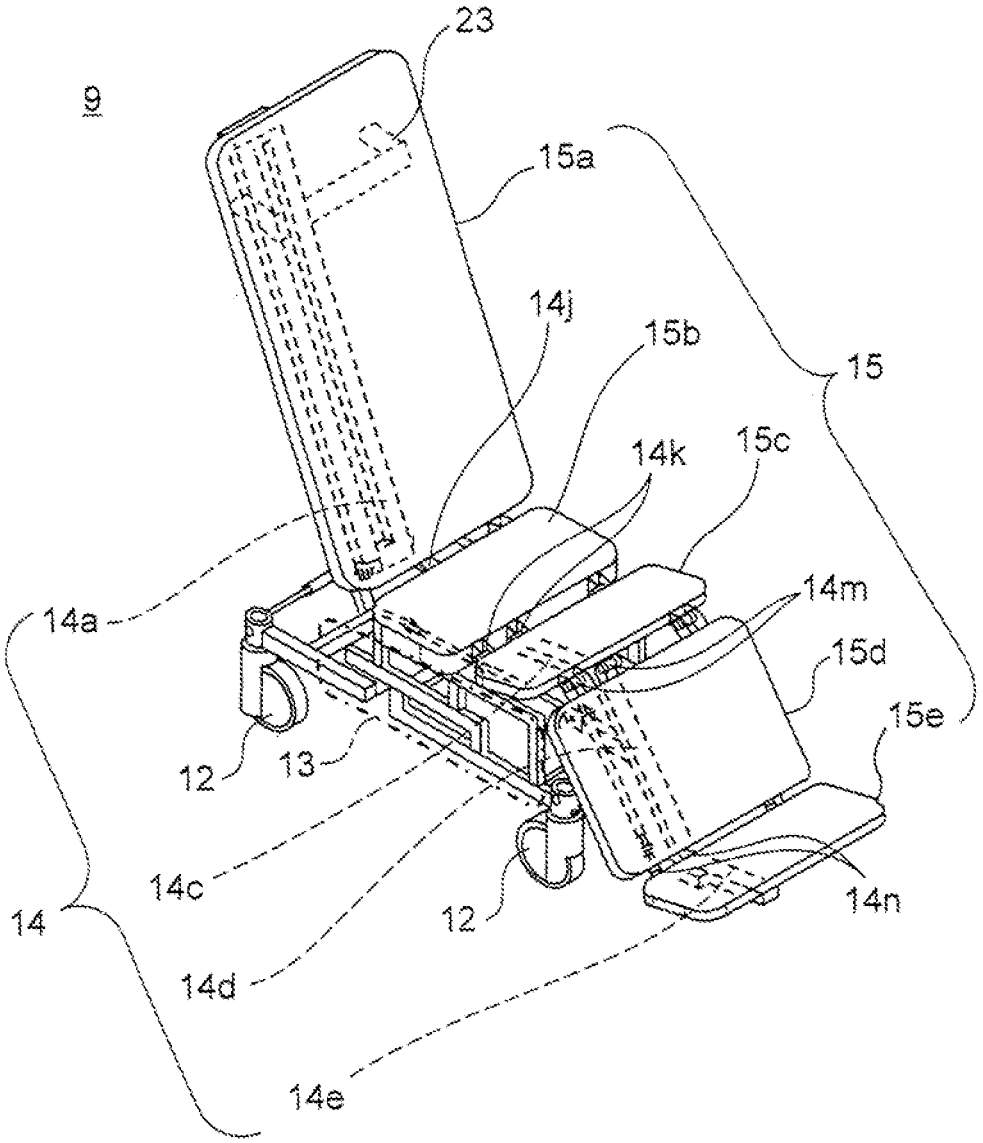
FIG. 2A is a perspective view of a wheelchair in a seating posture state in the first embodiment.

FIG. 2A is a perspective view of the wheelchair 9 in a seating posture state.

The chair base portion 13 has the four traveling wheels 12 in a lower part thereof. The wheelchair 9 is moved by these four traveling wheels 12. In the first embodiment, there is no power in the wheelchair 9 but the wheelchair is moved by hand. The wheelchair 9 is moved when a nurse, a caregiver, or the like (hereinafter, abbreviated as the caregiver) pushes a handle 23 provided in the chair bottom support member 14.

The seating bottom portion 15 is composed of the chair back bottom member 15*a*, the chair waist bottom member 15*b*, the chair knee bottom member 15*c*, the chair leg first bottom member 15*d*, and the chair leg second bottom member 15*e*. Among the members composing the seating bottom portion, the adjacent members are bendably coupled to each other via the coupling parts of thin parts or hinges. The coupling parts of the thin parts may be composed of parts each having a thickness thinner than a thickness of each of the chair back bottom member 15*a* to the chair leg second bottom member 15*e* mainly composing the seating bottom portion 15, and thereby the coupling parts are bendable. The chair back bottom member 15*a*, the chair waist bottom member 15*b*, the chair knee bottom member 15*c*, the chair leg first bottom member 15*d*, and the chair leg second bottom member 15*e* are parts to be brought into contact with a back, a waist, knees, legs, and heels of the care-receiver, respectively. The chair back bottom member 15*a*, the chair waist bottom member 15*b*, the chair knee bottom member 15*c*, the chair leg first bottom member 15*d*, and the chair leg second bottom member 15*e* usually each have a cushion function. It should be noted that the chair leg second bottom member 15*e* serves as a footrest when the wheelchair 9 is in the seating posture.

Figure 2B:
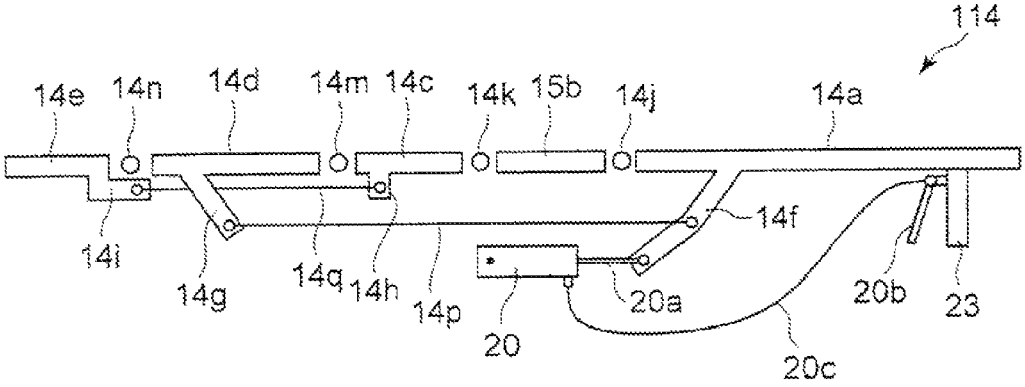
FIG. 2B is a schematic side view of a link mechanism of the wheelchair in the first embodiment in a flat posture state.

As shown in FIG. 2B, the chair bottom support member 14 is composed of the square frame shape chair back bottom support member (chair back guide member) 14*a*, the square frame shape chair knee bottom support member (chair knee guide member) 14*c*, the square frame shape chair leg first support member (chair leg first guide member) 14*d*, the square pole shape chair leg second support member (chair leg second guide member) 14*e*, and four chair first to fourth bending portions 14*j*, 14*k*, 14*m*, 14*n* bendably coupling the adjacent support members each other. The chair back bottom support member 14*a* is capable of supporting the chair back bottom member 15*a*. The chair base portion 13 is capable of supporting the chair waist bottom member 15*b*. The chair knee bottom support member 14*c* supports the chair knee bottom member 15*c*. The chair leg first support member 14*d* is capable of supporting the chair leg first bottom member 15*d*. The chair leg second support member 14*e* is capable of supporting the chair leg second bottom member 15*e*. The chair back bottom support member 14*a* and the chair waist bottom member 15*b* are bendably coupled to each other by the chair first bending portion 14*j*. The chair waist bottom member 15*b* and the chair knee bottom support member 14*c* are bendably coupled to each other by the chair second bending portion 14*k*. The chair knee bottom support member 14*c* and the chair leg first support member 14*d* are bendably coupled to each other by the chair third bending portion 14*m*. The chair leg first support member 14*d* and the chair leg second support member 14*e* are bendably coupled to each other by the chair fourth bending portion 14*n*. The handle 23 is fixed to a front end on the back surface side of the chair back bottom support member 14*a*.

Since the chair waist bottom member 15*b*, the chair back bottom support member 14*a*, and the chair knee bottom support member 14*c* are coupled to one another, position displacement is not generated between the chair bottom member 15 and the chair bottom support member 14.

The wheelchair 9 of this first embodiment is provided with a chair bottom support member biasing section for always imposing bias force on the chair back bottom support member 14*a* from the flat posture along the horizontal direction toward the seating posture oblique relative to the vertical direction. As one example of the chair bottom support member biasing section, a gas damper 20 is used. However, a translation actuator can be used instead. A hand brake 20*b* of the gas damper 20 is attached to the chair back bottom support member 14*a* beside the handle 23, and the hand brake 20*b* and the gas damper 20 are coupled to each other by a brake wire 20*c*. A piston rod 20*a* of the gas damper 20 is coupled to a front end of a branch coupling portion 14*f* branched on a back surface on the base end side of the chair back bottom support member 14*a*. This piston rod 20*a* is capable of pivoting the chair back bottom support member 14*a* between the seating posture and the flat posture via the first bending portion 14*j* between the chair back bottom support member 14*a* and the chair waist bottom portion 15*b*. An intermediate part of the branch coupling portion 14*f* of the chair back bottom support member 14*a* is coupled to a front end of a branch coupling portion 14*g* branched on a back surface of an end on the chair leg second bottom member side of the chair leg first support member 14*d* by a first coupling link member 14*p*. Therefore, in the posture change mechanism 114 of the present embodiment, irrespective of a pivoting action of the chair back bottom support member 14*a* about the chair first bending portion 14*j*, a gap between the intermediate part of the branch coupling portion 14*f* of the chair back bottom support member 14*a* and the front end of the branch coupling portion 14*g* of the chair leg first support member 14*d* is always the same. In the posture change mechanism 114, a tensile force is imposed from the chair knee bottom support member 14*c* to the chair leg first support member 14*d* or the tensile force is cancelled in such a manner that the gap between the intermediate part of the branch coupling portion 14*f* and the front end of the branch coupling portion 14*g* is always the same. A front end of a branch coupling portion 14*h* and a front end of a branch coupling portion 14*j* are coupled to each other by a second coupling link member 14*q*. Here, the branch coupling portion 14*h* is branched on a back surface of an end on the chair leg first support member side of the chair knee bottom support member 14*c*. The branch coupling portion 14*j* is branched on a back surface of an end on the chair leg first support member side of the chair leg second support member 14*e*. Therefore, irrespective of the pivoting action of the chair back bottom support member 14*a* about the chair first bending portion 14*j*, a gap between the front end of the branch coupling portion 14*h* of the chair knee bottom support member 14*c* and the front end of the branch coupling portion 14*j* of the chair leg second support member 14*e* is always the same. As will be described later, when a shape of the seating bottom portion 15 of the wheelchair 9 is changed between the flat posture and the seating posture, the first coupling link member 14*p* and the second coupling link member 14*q* function to easily and reliably form the postures.

Figure 3A:
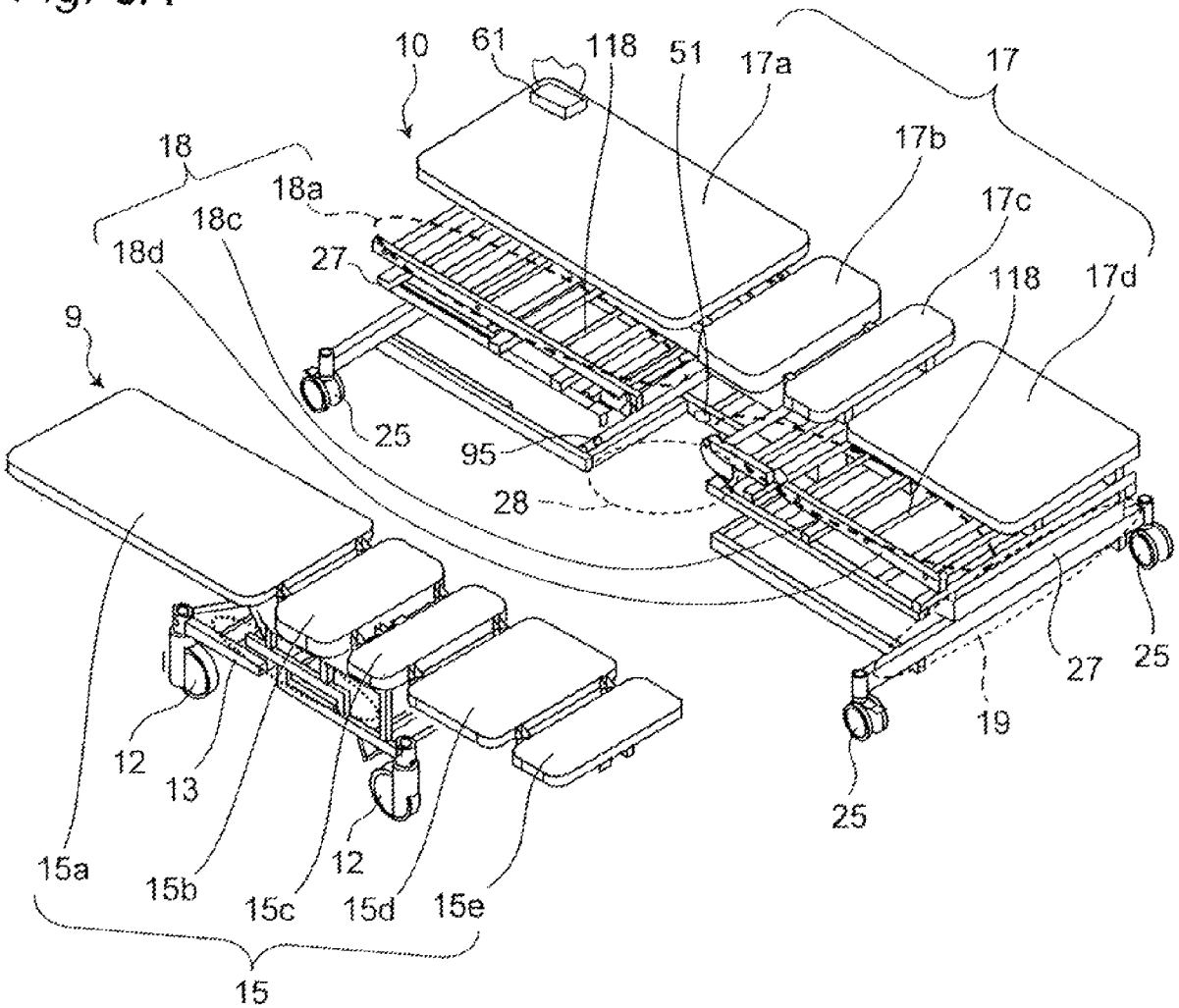
FIG. 3A is a perspective view of the bed at the time of the separation when the wheelchair is in a flat posture in the first embodiment.

In the wheelchair 9, the shape of the seating bottom portion 15 can be changed from the seating posture to the flat posture. Here, as shown in FIG. 2A, the seating posture is a posture in which the chair back bottom member 15*a* is lifted, the chair knee bottom member 15*c* is inclined slightly upward relative to the chair waist bottom member 15*b*, and the chair leg first bottom member 15*d* and the chair leg second bottom member 15*e* are lowered downward. As shown in FIG. 3A, the flat posture is a posture in which the entire seating bottom portion 15 becomes a flat surface.

The seating posture will be described in detail based on FIG. 2A. In the seating posture, the chair back bottom member 15*a* and the chair back bottom support member 14*a* stand up obliquely in the vertical direction in such a manner that upper ends thereof are positioned on the rear side of lower ends. The chair waist bottom member 15*b* is positioned substantially along the horizontal direction. The chair knee bottom member 15*c* and the chair knee bottom support member 14*c* are positioned slightly obliquely in such a manner that ends on the side of the chair waist bottom member 15*b* are positioned on the lower side of ends on the side of the chair leg first bottom member 15*d*. The chair leg first bottom member 15*d* and the chair leg first support member 14*d* are positioned obliquely downward from ends on the chair knee bottom support member side to ends on the chair leg second bottom member side. The chair leg second bottom member 15*e* and the chair leg second support member 14*e* are positioned substantially in the horizontal direction or slightly obliquely upward from ends on the chair leg first bottom member side to a front end of the chair leg second bottom member 15*e*.

In the flat posture, the chair back bottom member 15*a*, the chair waist bottom member 15*b*, the chair knee bottom member 15*c*, the chair leg first bottom member 15*d*, and the chair leg second bottom member 15*e* form one flat surface substantially along the horizontal direction. In other words, the chair back bottom support member 14*a*, the chair knee bottom support member 14*c*, the chair leg first support member 14*d*, and the chair leg second support member 14*e* form one flat surface substantially along the horizontal direction, and this flat surface and the longitudinal directions of the first coupling link member 14*p*, the second coupling link member 14*q*, and the piston rod 20*a* of the gas damper 20 are parallel to each other.

That is, with the above configuration of the link mechanism of the wheelchair 9, when the caregiver grips the hand brake 20*b* of the gas damper 20, the bias force of the gas damper 20 can be imposed on the chair back bottom support member 14*a*, so that a protruding amount (length) of the piston rod 20*a* of the gas damper 20 can be changed. When the hand is released from the hand brake 20*b* of the gas damper 20, the piston rod 20*a* of the gas damper 20 is locked with the protruding amount (length) of that time, and the posture is maintained.

Figure 2C:
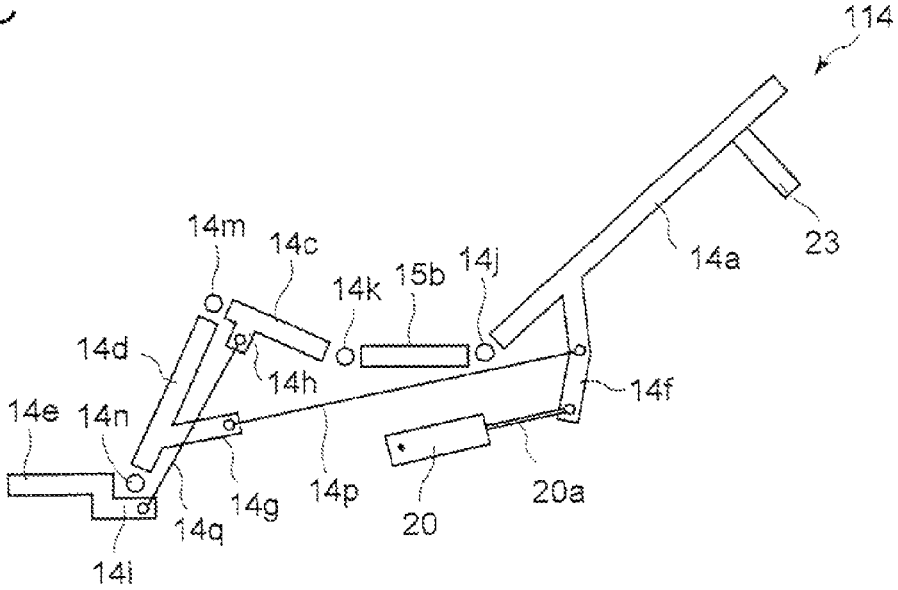
FIG. 2C is a schematic side view of the link mechanism of the wheelchair in the first embodiment in the seating posture state.

Therefore, for example, when the caregiver grips the hand brake 20*b* of the gas damper 20 in the flat posture as shown in FIG. 2B, lock of the piston rod 20*a* of the gas damper 20 is cancelled, so that the bias force of the gas damper 20 can be imposed on the chair back bottom support member 14*a*. Therefore, even when the care-receiver gets on the wheelchair 9 and the back of the care-receiver is supported by the chair back bottom member 15*a* and the chair back bottom support member 14*a*, the bias force of the gas damper 20 and the weight of the care-receiver are substantially cancelled out, so that the caregiver can easily perform the posture change. That is, the bias force of the gas damper 20 and the weight of the care-receiver are substantially cancelled out, and the caregiver can change the chair back bottom support member 14*a* from the flat posture to the seating posture and from the seating posture to the flat posture. The strength of the bias force of the gas damper 20 is preferably preliminarily adjusted so as to be cancelled out with the weight of the care-receiver. By imposing the bias force of the gas damper 20 on the chair back bottom support member 14*a* in such a way, for example, when the flat posture is changed to the seating posture, the chair back bottom support member 14*a* can be easily pivoted anticlockwise of FIG. 2B about the chair first bending portion 14*j*. Then, the chair leg first support member 14*d* is pulled to the chair back bottom support member side via the first coupling link member 14*p*, and the chair knee bottom support member 14*c* is pivoted clockwise about the chair second bending portion 14*k* relative to the chair waist bottom portion 15*b*. At the same time as this clockwise pivoting, the chair leg first support member 14*d* is pivoted anticlockwise about the chair third bending portion 14*m*, and the chair leg second support member 14*e* is pivoted clockwise about the chair fourth bending portion 14*n* via the second coupling link member 14*q*. Therefore, as shown in FIG. 2C, the wheelchair 9 can be changed from the flat posture to the seating posture.

Conversely, at the time of performing the posture change from the seating posture to the flat posture, when the caregiver grips the handle 23 with one hand thereof while gripping the hand brake 20*b* with the other hand thereof in the seating posture state of the wheelchair 9, the lock of the piston rod 20*a* of the gas damper 20 is cancelled, so that the bias force of the gas damper 20 can be imposed on the chair back bottom support member 14*a*. At this time, by utilizing the weight of the care-receiver, the chair back bottom support member 14*a* is manually brought downward. That is, the chair back bottom support member 14*a* can be easily and slowly pivoted clockwise of FIG. 2B about the chair first bending portion 14*j*. Then, the tensile force imposed on the first coupling link member 14*p* is cancelled and loosened, and the chair knee bottom support member 14*c* and the chair leg first support member 14*d* are respectively relatively pivoted about the chair second bending portion 14*k*, the chair third bending portion 14*m*, and the chair fourth bending portion 14*n* and respectively changed from an obliquely inclined posture to the flat posture, thereby performing the posture change. This posture change is performed by weight of the vicinity of the knees of the care-receiver imposed on the chair knee bottom support member 14*c* via the chair knee bottom member 15*c*, and by weight of the legs of the care-receiver imposed on the chair leg first support member 14*d* via the chair leg first bottom member 15*d*. That is, the chair knee bottom support member 14*c* is pivoted anticlockwise about the chair second bending portion 14*k*, and at the same time, the chair leg first support member 14*d* is pivoted clockwise about the chair third bending portion 14*m*, and the chair leg second support member 14*e* is pivoted anticlockwise about the chair fourth bending portion 14*n* via the second coupling link member 14*q*. Therefore, the postures of the chair knee bottom support member 14*c* supporting the chair knee bottom member 15*c* of a leg surface part, the chair leg first support member 14*d* supporting the chair leg first bottom member 15*d*, and the chair leg second support member 14*e* supporting the chair leg second bottom member 15*e* are changed so as to be close to the flat posture. Further, when the chair back bottom support member 14*a* is brought down until the chair back bottom member 15*a* and the chair waist bottom member 15*b* are in a flat surface, the chair waist bottom member 15*b*, the chair knee bottom member 15*c*, the chair leg first bottom member 15*d*, and the chair leg second bottom member 15*e* are also in one flat surface. The chair back bottom member 15*a*, the chair waist bottom member 15*b*, the chair knee bottom member 15*c*, the chair leg first bottom member 15*d*, and the chair leg second bottom member 15*e* are in one continuous flat surface. As shown in FIG. 2B, the wheelchair 9 is changed from the seating posture to the flat posture. This is because of the link mechanism in which the chair bottom support member 14 supports the seating bottom portion 15, and in conjunction with inclination of the chair back bottom support member 14*a*, the postures of the chair knee bottom support member 14*c*, the chair leg first support member 14*d*, and the chair leg second support member 14*e* are changed via the first coupling link member 14*p* and the second coupling link member 14*q*.

The chair leg second support member 14*e* is coupled to the chair knee bottom support member 14*c* via the second coupling link member 14*q*. Thus, the chair leg second support member 14*e* is only moved parallel in a vertical direction whether the wheelchair 9 is in the flat posture or the seating posture, and always maintains a position along the horizontal direction.

With such a configuration, in the wheelchair 9 of the first embodiment, only by changing inclination of the chair back bottom member 15*a* of the wheelchair 9, the postures of the chair knee bottom member 15*c*, the chair leg first bottom member 15*d*, and the chair leg second bottom member 15*e* can be changed in conjunction with the change. That is, only by performing one action by the caregiver, the wheelchair 9 performs the posture change of the back and the legs simultaneously. Thus, the posture change of the wheelchair 9 can be easily and reliably performed although the posture change is manually performed.

FIG. 3A is a perspective view of the bed 11 at the time of the separation in which the seating bottom portion 15 of the wheelchair 9 is in the flat posture in order to combine the wheelchair 9 and the bed main body portion 10. At this time, the bed bottom portion 17 of the bed main body portion 10 is also in the flat posture.

The bed bottom portion 17 has the bed back bottom member 17*a*, the bed waist bottom member 17*b*, the bed knee bottom member 17*c*, and the bed leg bottom member 17*d* bendably coupled to one another. That is, the bed bottom portion 17 is composed of the four bed bottom members 17*a*, 17*b*, 17*c*, 17*d*. Among these members, the adjacent members are bendably coupled to each other at three points via the coupling parts of thin parts or hinges. The coupling parts of the thin parts may be composed of parts each having a thickness thinner than a thickness of each of the bed back bottom member 17*a* to the bed leg bottom member 17*d* mainly composing the bed bottom portion 17, and thereby the coupling parts are bendable. The bed back bottom member 17*a*, the bed waist bottom member 17*b*, the bed knee bottom member 17*c*, and the bed leg bottom member 17*d* are parts to be brought into contact with the back, the waist, the knees, and the legs including the heels of the care-receiver, respectively, and generally have the cushion function.

It should be noted that since the seating bottom portion 15 has the five divided members 15*a*, 15*b*, 15*c*, 15*d*, 15*e* and are bent at four points, a division structure is different between the bed bottom portion 17 and the seating bottom portion 15. However, the three divided members 17*a*, 17*b*, 17*c* of the bed bottom portion 17 respectively correspond to the three divided members 15*a*, 15*b*, 15*c* of the seating bottom portion 15, and the remaining one divided member 17*d* of the bed bottom portion 17 corresponds to the remaining two divided members 15*d*, 15*e* of the seating bottom portion 15.

As shown in FIG. 3A, the bed bottom support member 18 is composed of the bed back bottom support member 18*a* composed into a ladder shape in which a large number of crosspieces are fixed in the width direction between a pair of support rod members in the longitudinal direction, the bed knee bottom support member 18*c* composed into a similar ladder shape to the bed back bottom support member 18*a*, the bed leg bottom support member 18*d* composed into a similar ladder shape to the bed back bottom support member 18*a*, and three bed first to third bending portions 18*j*, 18*k*, 18*m* bendably coupling the adjacent support members to each other. The bed back bottom support member 18*a* always supports the bed back bottom member 17*a*, and a protruding portion 118 protruding in the width direction from the bed back bottom member 17*a* is capable of supporting the chair back bottom member 15*a*. The bed knee bottom support member 18*c* always supports the bed knee bottom member 17*c*, and a protruding portion 118 protruding in the width direction from the bed knee bottom member 17*c* is capable of supporting the chair knee bottom member 15*c*. The bed leg bottom support member 18*d* always supports the bed leg bottom member 17*d*, and a protruding portion 118 protruding in the width direction from the bed leg bottom member 17*d* is capable of supporting the chair leg first bottom member 15*d* and the chair leg second bottom member 15*e*. In such a way, the bed back bottom support member 18*a*, the bed knee bottom support member 18*c*, and the bed leg bottom support member 18*d* respectively compose the protruding portions 118 respectively exposed to protrude on one side in the width direction from the bed back bottom member 17*a*, the bed waist bottom member 17*b*, the bed knee bottom member 17*c*, and the bed leg bottom member 17*d*. These protruding portions 118 are capable of supporting the chair back bottom member 15*a*, the chair waist bottom member 15*b*, the chair knee bottom member 15*c*, the chair leg first bottom member 15*d*, and the chair leg second bottom member 15*e* of the wheelchair 9 after the wheelchair 9 is combined with the bed main body portion 10.

That is, the bed back bottom support member 18*a* and the bed waist bottom member 17*b* are bendably coupled to each other by the bed first bending portion 18*j*. The bed waist bottom member 17*b* and the bed knee bottom support member 18*c* are bendably coupled by the bed second bending portion 18*k*. The bed knee bottom support member 18*c* and the bed leg bottom support member 18*d* are bendably coupled to each other by the bed third bending portion 18*m*.

Since the bed waist bottom member 17*b*, the bed back bottom support member 18*a*, and the chair knee bottom support member 18*c* are coupled to one another, the position displacement is not generated between the bed bottom member 17 and the bed bottom support member 18.

In an end on the back surface side of the bed base portion 19 positioned on the lower side of a front end on the back surface side of the bed back bottom support member 18*a* in the flat posture, a first flat posture detection sensor 21 is arranged. By contact with the front end on the back surface side of the bed back bottom support member 18*a* in the flat posture, the first flat posture detection sensor 21 detects that the bed back bottom support member 18*a* is in the flat posture. In an end on the leg side of the bed base portion 19 positioned on the lower side of a front end on the back surface side of the bed leg bottom support member 18*d*, a second flat posture detection sensor 22 is arranged. By contact with the front end on the back surface side of the bed leg bottom support member 18*d* in the flat posture, the second flat posture detection sensor 22 detects that the bed leg bottom support member 18*d* is in the flat posture. The first flat posture detection sensor 21 and the second flat posture detection sensor 22 can be, for example, respectively composed of limit switches for respectively detecting the contact of the bed back bottom support member 18*a* in the flat posture and the contact of the bed leg bottom support member 18*d* in the flat posture. Detection information of the first flat posture detection sensor 21 and the second flat posture detection sensor 22 is respectively outputted to a control section 100, and the control section 100 can respectively determine the flat posture of the bed back bottom support member 18*a* and the flat posture of the bed leg bottom support member 18*d*.

Figure 1C:
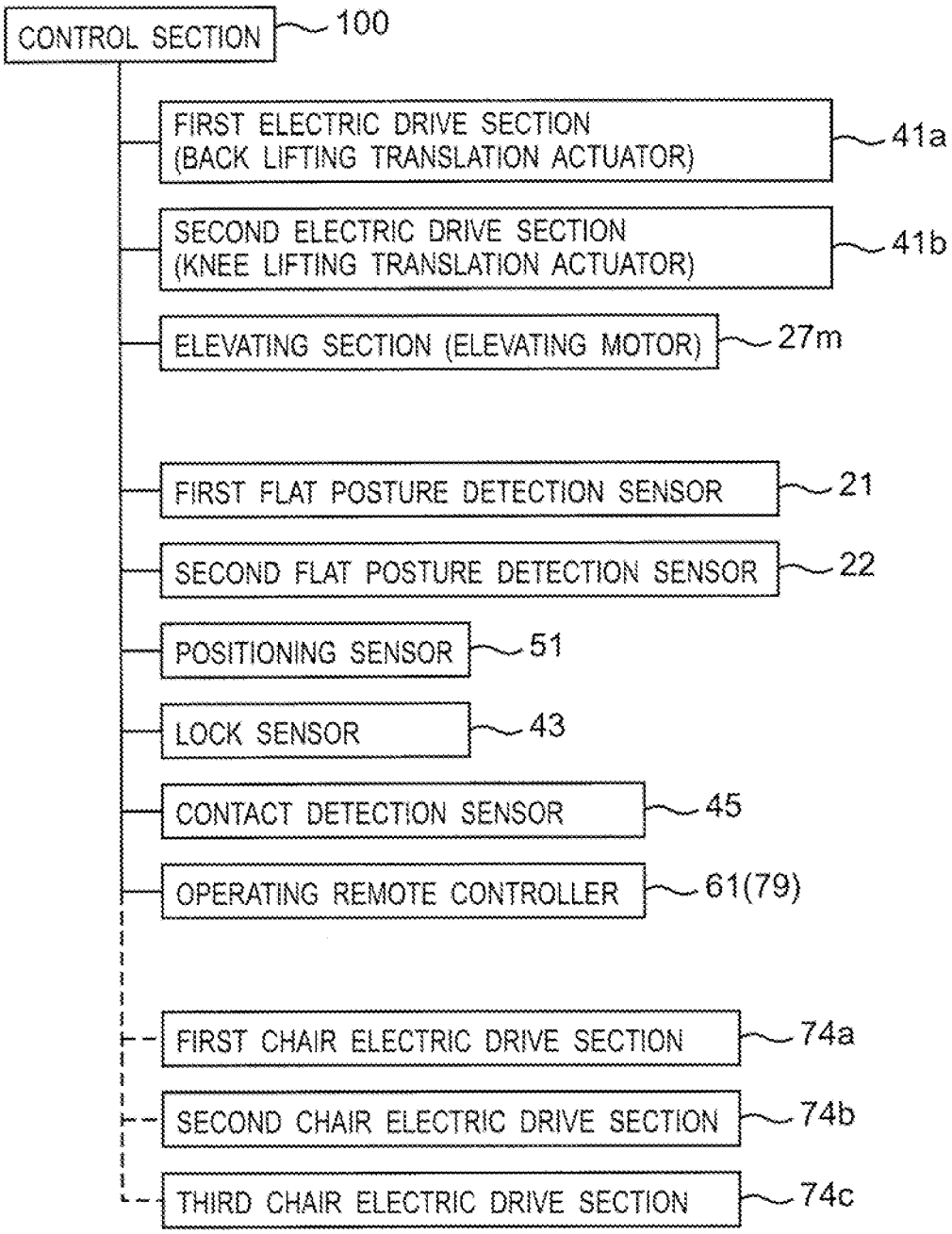
FIG. 1C is a block diagram of a control section and the like of the bed in the first embodiment of the present invention.

As shown in FIG. 1C, the control section 100 is to control actions of a combining method and a separating method of the bed, and to control drive of a drive section or a drive device based on input information from the sensors.

A rotatable roller 24 is arranged on the front end of the bed leg bottom support member 18*d*. In the back lifting posture and the knee lifting posture, the roller 24 rolls and moves on a flat rail or an interior of a groove of the bed base portion 19, so that the bed leg bottom support member 18*d* can smoothly perform a bending or bending cancellation action between the knee lifting posture and the flat posture relative to the bed base portion 19.

In the first embodiment, a first electric drive section 41*a* and a second electric drive section 41*b* are further provided so that a back lifting action and a knee lifting action are independently performed on a bed bottom portion 16 composed of integrating the seating bottom portion 15 and the bed bottom portion 17.

The first electric drive section 41*a* can change inclination of the back bottom support member 18*a*. The second electric drive section 41*b* can change the postures of the knee bottom support member 18*c* and the leg bottom support member 18*d*.

An arm 42*a* of a back lifting translation actuator 41*a* serving as one example of the first electric drive section 41*a* is coupled to a front end of a branch coupling portion 18*f* branched on a back surface on the base end side of the bed back bottom support member 18*a* so as to lift or bring down the bed back bottom support member 18*a* via the arm 42*a*. Therefore, by driving the back lifting translation actuator 41*a* so as to make the piston rod 42*a* travel back and forth, the bed back bottom support member 18*a* can be pivoted between the seating posture and the flat posture via the first bending portion 18*j* between the bed back bottom support member 18*a* and the bed waist bottom member 17*b*.

Figure 7A:
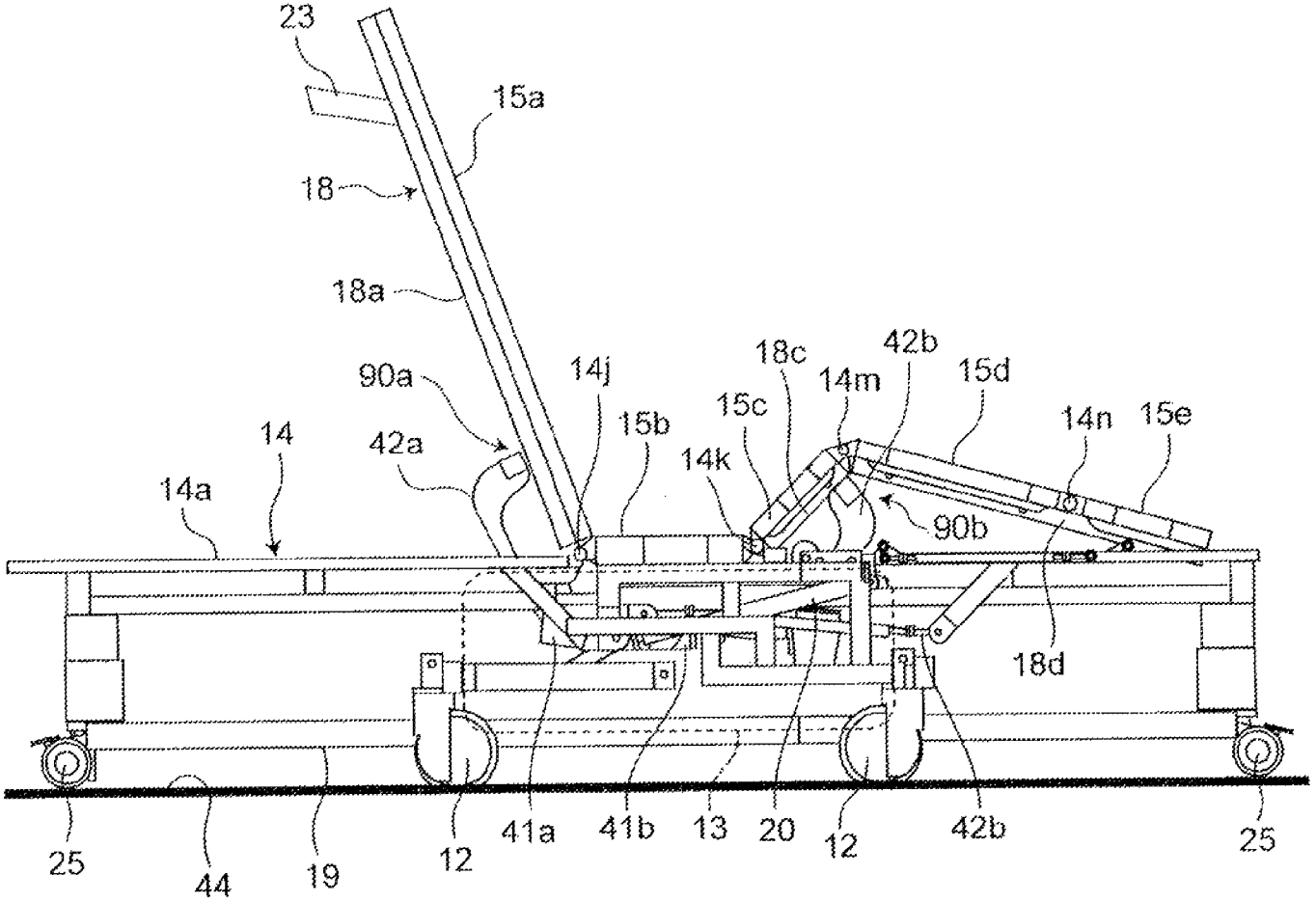
FIG. 7A is a side view of the bed in the back lifting posture and knee lifting posture states and in a bed lowering state in the first embodiment.
Figure 7B:
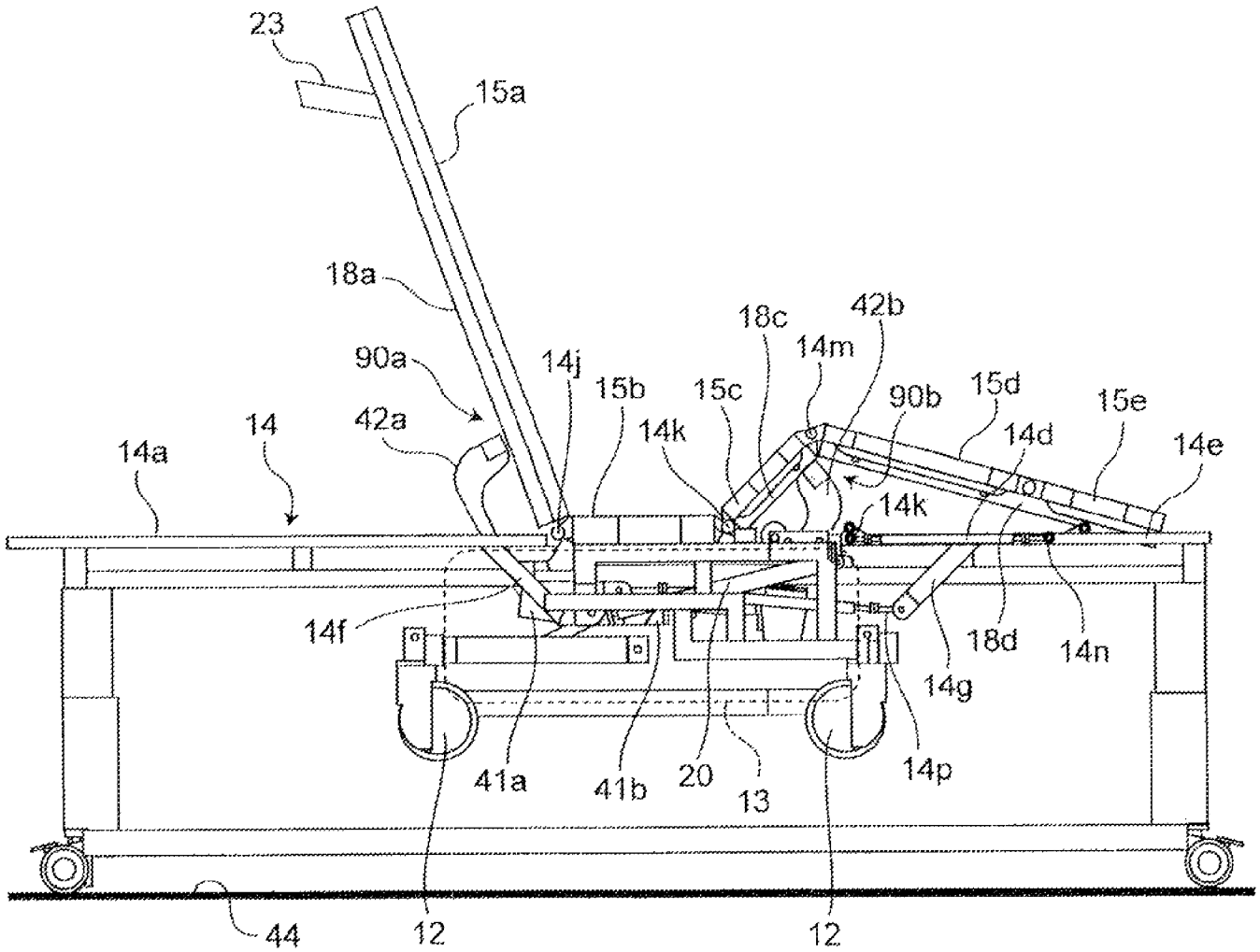
FIG. 7B is a side view of the bed in the back lifting posture and knee lifting posture states and in a bed raising state in the first embodiment.

It should be noted that as another example, as shown in FIGS. 7A and 7B, instead of providing the branch coupling portion 18*f* on the back surface on the base end side of the bed back bottom support member 18*a*, a front end of the piston rod 42*a* may be curved toward the base end side of the bed back bottom support member 18*a* so as to be separably bring into contact with the back surface on the base end side of the bed back bottom support member 18*a*. In such a way, only when the bed back bottom support member 18*a* stands up, the back lifting translation actuator 41*a* is driven and the back surface on the base end side of the bed back bottom support member 18*a* is pressed by the piston rod 42*a*. Meanwhile, when the bed back bottom support member 18*a* is brought down to the flat posture, by not pulling the bed back bottom support member 18*a* by the piston rod 42*a* but only by driving the back lifting translation actuator 41*a* so as to retreat the piston rod 42*a*, the bed back bottom support member 18*a* may be brought down with utilizing the weight of the care-receiver. Therefore, in this case, the back surface of the bed back bottom support member 18*a* and the front end of the piston rod 42*a* are simply brought into contact with each other and easily separable for each other, so that a force transmission switching mechanism 90*a* for switching between transmission and blocking of force for a kind of posture change is formed.

Figure 3B:
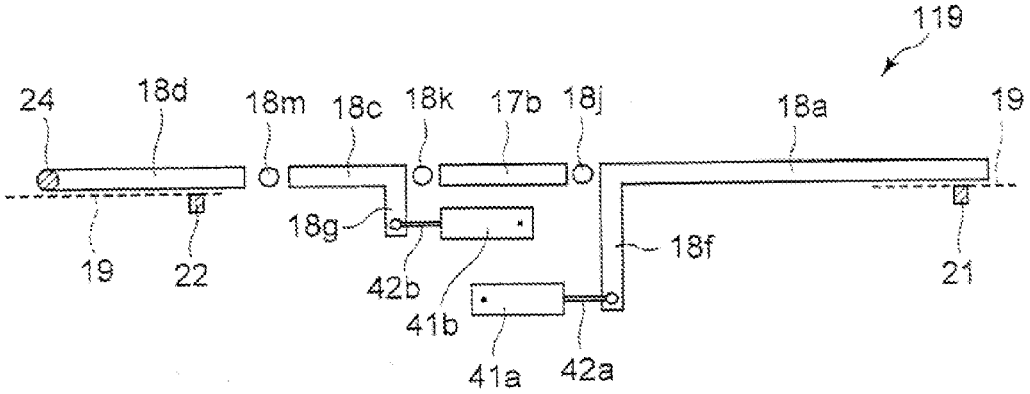
FIG. 3B is a schematic side view of a link mechanism of a bed main body portion in the first embodiment in the flat posture state.
Figure 3C:
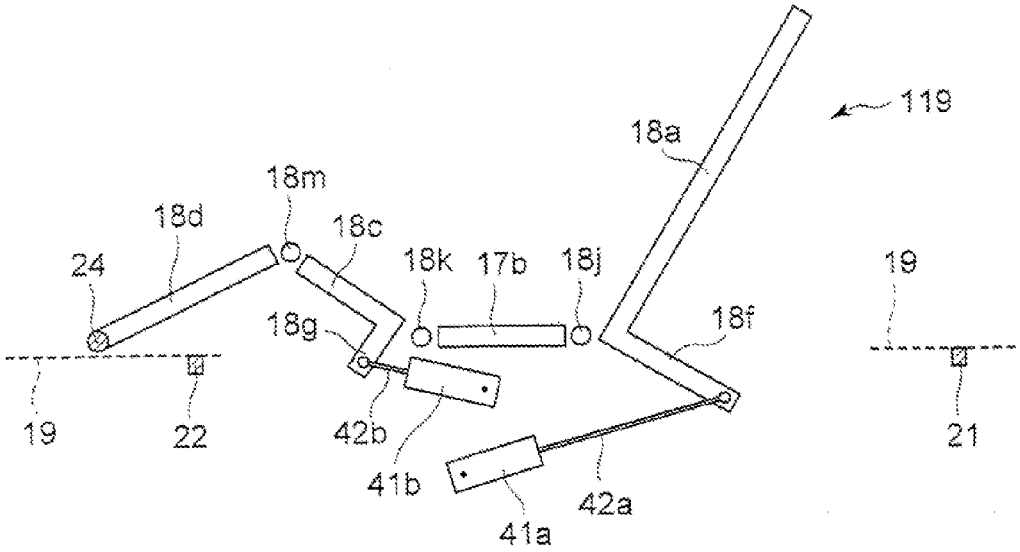
FIG. 3C is a schematic side view of the link mechanism of the bed main body portion in the first embodiment in the seating posture state.

An arm 42*b* of a knee lifting translation actuator 41*b* serving as one example of the second electric drive section is coupled to a front end of a branch coupling portion 18*g* branched on a back surface on the base end side of the bed knee bottom support member 18*c* so as to lift or bring down the bed knee bottom support member 18*c* via the arm 42*b*, so that the bed knee bottom support member 18*c* and the bed leg bottom support member 18*d* are bent into an inverted V shape or made to be a flat surface. Therefore, by driving the knee lifting translation actuator 41*b* so as to extend the piston rod 42*b*, the bed knee bottom support member 18*c* is pivoted clockwise about the bed second bending portion 18*k* relative to the bed waist bottom member 17*b*, and at the same time, the bed leg bottom support member 18*d* is pivoted anticlockwise about the bed third bending portion 18*m*. Thus, as shown in FIG. 3C, the bed main body portion 10 can be changed from the flat posture to the back lifting posture and the knee lifting posture. Conversely, by driving the knee lifting translation actuator 41*b* so as to contract the piston rod 42*a*, the bed knee bottom support member 18*c* is pivoted anticlockwise about the bed second bending portion 18*k* relative to the bed waist bottom member 17*b*, and at the same time, the bed leg bottom support member 18*d* is pivoted clockwise about the bed third bending portion 18*m*. Therefore, as shown in FIG. 3B, the bed main body portion 10 can be changed from the back lifting posture and the knee lifting posture to the flat posture.

It should be noted that as another example, as shown in FIGS. 7A and 7B, instead of providing the branch coupling portion 18*g* on the back surface on the base end side (the side of the leg bottom support member 18*d*) of the bed knee bottom support member 18*c*, a front end of the piston rod 42*b* may be curved toward the base end side of the bed knee bottom support member 18*c* so as to be separably brought into contact with the back surface on the base end side of the bed knee bottom support member 18*c*. In such a way, only when the bed knee bottom support member 18*c* stands up, the back lifting translation actuator 41*b* is driven and the back surface on the base end side of the bed knee bottom support member 18*c* is pressed by the piston rod 42*b*. Meanwhile, when the bed knee bottom support member 18*c* is brought down to the flat posture, by not pulling the bed knee bottom support member 18*c* by the piston rod 42*b* but only by driving the back lifting translation actuator 41*b* so as to retreat the piston rod 42*b*, the bed knee bottom support member 18*c* may be brought down with utilizing the weight of the care-receiver. Therefore, in this case, the back surface of the bed knee bottom support member 18*c* and the front end of the piston rod 42*b* are simply brought into contact with each other and easily separable for each other, so that a force transmission switching mechanism 90*b* for switching between the transmission and the blocking of the force for a kind of posture change is formed.

The back lifting translation actuator 41*a* and the knee lifting translation actuator 41*b* are respectively independently driven. Thus, a back lifting action/back lowering action and a knee lifting action/knee lowering action can be independently performed. By respectively operating the back lifting translation actuator 41*a* and the knee lifting translation actuator 41*b* by an operating remote controller 61 as described later, the care-receiver can autonomously perform the back lifting action and the knee lifting action from his/her own motive.

On one of left and right sides in the width direction of the bed bottom portion 17 (for example, on the left side in FIG. 3A), the recess portion 28 serving as the combination area is formed as a space into which the chair base portion is inserted between the bed back bottom support member 18*a* and the bed knee bottom support member 18*c*, so that the chair base portion 13 of the wheelchair 9 is insertable into the recess portion 28.

The elevating section 27 functioning as one example of an elevating machine of the bed main body portion 10 is a part of the members composing the bed main body portion 10, is arranged between the bed bottom support member 18 and the bed base portion 19, and is provided with a link mechanism extendable and contractible in the vertical direction so as to move the entire bed bottom support member 18 parallel in the vertical direction, and an elevating motor 27*m* coupled to a link of the link mechanism so as to extend and contract the link mechanism by forward/backward rotation of a rotation shaft. As a mechanism for coupling the rotation shaft of the elevating motor 27*m* to the link of the link mechanism so as to move the link mechanism up and down, for example, a mechanism in which a ball screw is rotated by the rotation shaft so as to make a nut member screwed to the ball screw travel back and forth in the axial direction and this linear motion is converted into a vertical motion by a pantagraph type link mechanism, or the like can be adopted. Although the bed waist bottom member 17*b* is fixed to the bed base portion 19 via the elevating section 27, the bed bottom support members 18*a*, 18*c*, 18*d* are supported bendably relative to the elevating section 27 (movably in the longitudinal direction relative to the elevating section 27 and partially separably in the vertical direction). Under control of the control section 100, the elevating motor 27*m* of the elevating section 27 is driven and the rotation shaft thereof is rotated forward and backward so as to extend and contract the elevating section 27 in the vertical direction, and the bed bottom support member 18 supported on the elevating section 27 can be moved parallel in the vertical direction between an upper end position for a combination action and a lower end position for a separation action, and within a bed elevating range d after the combination. A lowest end position of the bed elevating range d is the upper end position for the combination action. When the bed bottom support member 18 is positioned at the upper end position for the combination action, the bed bottom support member 18 is brought into contact with the seating bottom portion 15 of the chair 9 and the seating bottom portion 15 is brought up by the bed bottom support member 18. Thus, the seating bottom portion 15 is away from the chair bottom support member 14. Since the seating bottom portion 15 is away from the chair bottom support member 14, the seating bottom portion 15 of the chair 9 is supported only by the bed bottom support member 18 instead of the chair bottom support member 14. Meanwhile, when the bed bottom support member 18 is positioned at the lower end position for the separation action, the chair bottom support member 14 is brought into contact with the seating bottom portion 15 of the chair 9 and the seating bottom portion 15 is brought up by the chair bottom support member 14. Since the seating bottom portion 15 is brought up by the chair bottom support member 14, the seating bottom portion 15 is away from the bed bottom support member 18, and the seating bottom portion 15 is supported only by the chair bottom support member 14 instead of the bed bottom support member 18. By such an elevating action of the elevating section 27, the posture change mechanism of the seating bottom portion 15 can be switched between the chair bottom support member 14 and the bed bottom support member 18 by the support switching mechanism.

Figure 4A:
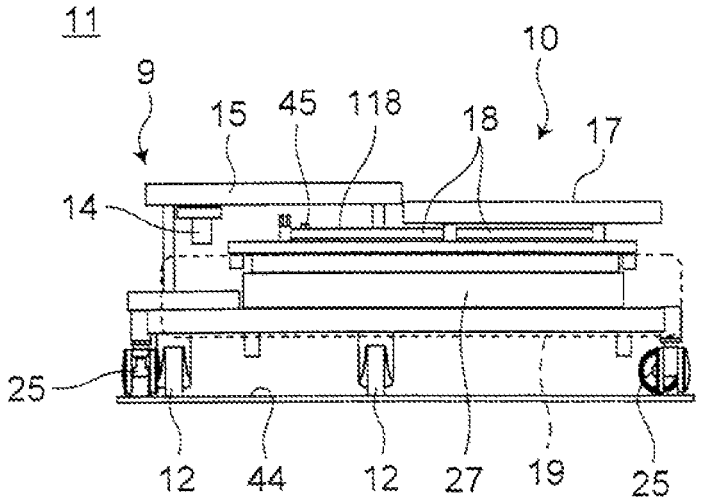
FIG. 4A is a front view in which the bed with a posture change mechanism being switched is seen from the front side of the bed in a state where a seating bottom portion is supported by a chair bottom support member in the first embodiment.

As shown in FIG. 4A, a contact detection sensor 45 serving as one example of a contact detection means for detecting that the bed bottom support member 18 supports the seating bottom portion 15 is provided in the bed bottom support member 18. Detection information of the contact detection sensor 45 is outputted to the control section 100. Therefore, based on the detection information of the contact detection sensor 45, the control section 100 can determine whether or not the bed bottom support member 18 supports the seating bottom portion 15.

Figure 9:
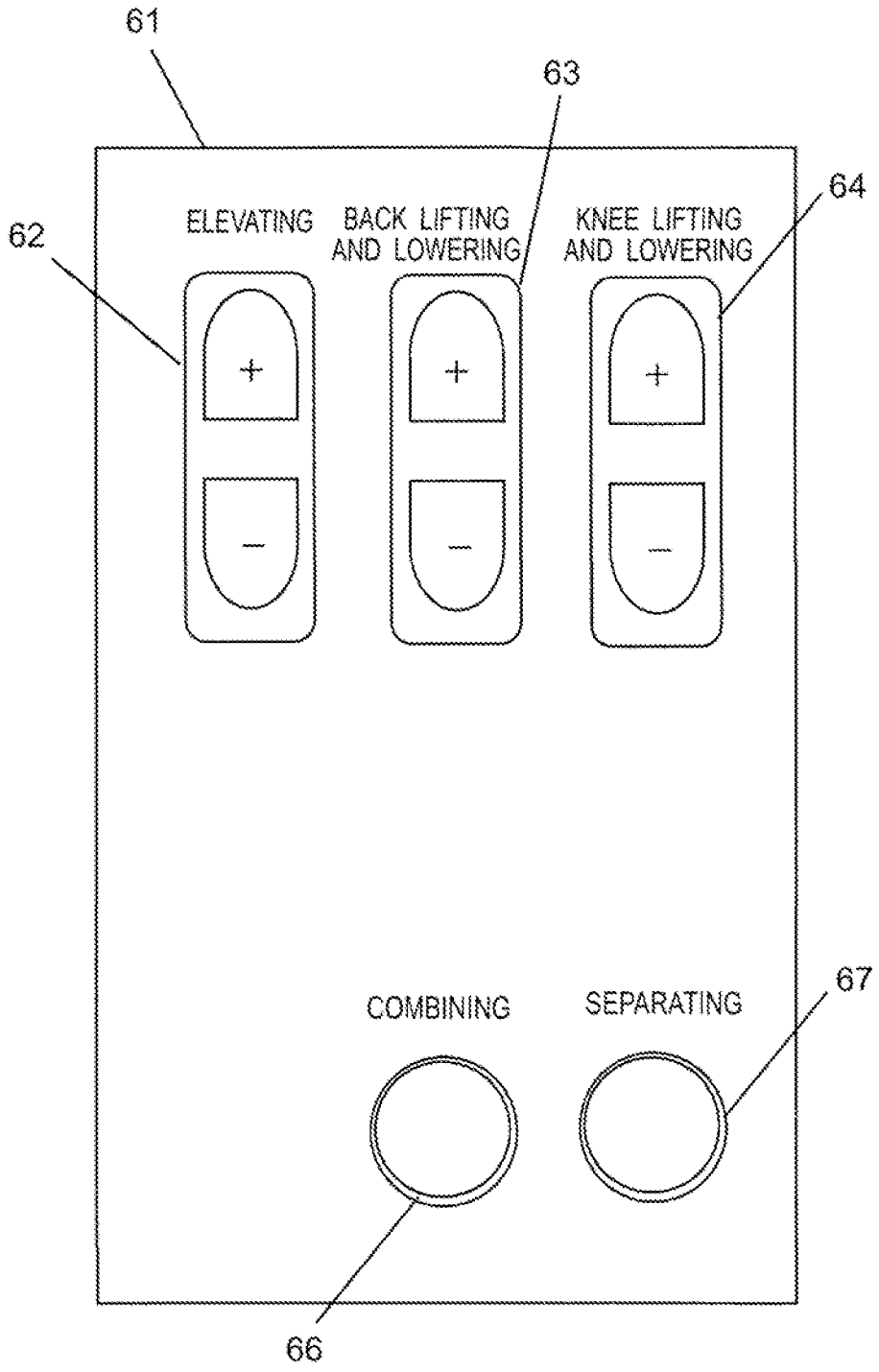
FIG. 9 is a view showing an operating surface of an operating remote controller in the first embodiment.

FIG. 9 is a view showing an operating surface of the operating remote controller 61. The operating remote controller 61 has an elevating button 62, a back lifting and lowering button 63, a knee lifting and lowering button 64, a combining button 66, and a separating button 67. The operating remote controller 61 is connected to the control section 100 of the bed main body portion 10 by a communication cord or wirelessly, and provides an operating instruction to the control section 100 so as to drive the back lifting translation actuator 41*a*, the knee lifting translation actuator 41*b*, and the elevating motor 27*m* of the elevating section 27. The operating remote controller is provided with a speaker for audibly notifying of various information.

The elevating button 62 is a switch for driving the elevating motor 27*m* of the elevating section 27, and changes height of the bed bottom portion 16 of the bed 11 after completion of the combination, in the vertical direction within the bed elevating range d. That is, the elevating button 62 is to perform operations of raising and lowering the bed bottom portion 16 within the bed elevating range d shown in FIG. 4B serving as a high range which is a position where the bed bottom support member 18 is brought into contact with the seating bottom portion 15 or more.

The back lifting and lowering button 63 is a switch for driving the back lifting translation actuator 41*a*, and performs the back lifting action or the back lowering action of the bed 11.

The knee lifting and lowering button 64 is a switch for driving the knee lifting translation actuator 41*b*, and performs the knee lifting action or the knee lowering action of the bed 11.

The combining button 66 is a switch for driving the elevating motor 27*m* of the elevating section 27 so as to combine the separated bed 11 (that is, to combine the wheelchair 9 and the bed main body portion 10), and raises the bed bottom support member 18 to the upper end position for the combination action by drive of the elevating motor 27*m* while the combining button 66 is being pressed.

The separating button 67 is a switch for driving the elevating motor 27*m* of the elevating section 27 so as to separate the combined bed 11, and lowers the bed bottom support member 18 to the lower end position for the separation action by the drive of the elevating motor 27*m* while the separating button 67 is being pressed. By pressing only the separating button 67, the elevating motor 27*m*, the back lifting translation actuator 41*a*, and the knee lifting translation actuator 41*b* may be driven, so that the bed 11 performs the back lowering action, the knee lowering action, and a lowering action so as to be changed to the flat posture, and the bed bottom portion 16 is lowered from the upper end position for the combination action to the lower end position for the separation action so as to become a state of capable of performing the separation action.

A positioning sensor 51 is provided in the bed base portion 19 in an innermost part of the recess portion 28 serving as the combination area, so as to detect that the chair base portion 13 is moved to and rightly positioned in the recess portion 28. As one example, the positioning sensor 51 is composed of a limit switch to be brought into contact with the chair base portion 13 when the chair base portion 13 is rightly positioned in the recess portion 28. Detection information of the positioning sensor 51 is outputted to the control section 100. Therefore, when the chair base portion 13 is not rightly positioned in the recess portion 28, the positioning sensor 51 cannot detect, and the control section 100 can determine that the chair base portion 13 is not rightly positioned in the recess portion 28.

A locking portion 40 for coupling and fixing the seating bottom portion 15 and the bed bottom portion 17 with a locking member (not shown) or canceling the coupling by manually pivoting a coupling lever 39 between a lock position and a lock cancellation position is provided in the bed base portion 19. When the seating bottom portion 15 and the bed bottom portion 17 are coupled and fixed by this locking portion 40, the seating bottom portion 15 and the bed bottom portion 17 are integrated so as to compose the bed bottom portion 16. The height of the bed bottom portion 16 at this time is the lowest state as the bed 11 at the time of the combination.

A lock sensor 43 for detecting whether or not the seating bottom portion 15 and the bed bottom portion 17 are locked by the locking portion 40 is provided in the bed base portion 19. The lock sensor 43 is, for example, composed of a limit switch or a proximity switch for detecting movement of the locking member when the seating bottom portion 15 and the bed bottom portion 17 are locked by the locking member of the locking portion 40. Detection information of the lock sensor 43 is respectively outputted to the control section 100, and the control section 100 determines whether or not the locking portion 40 provides lock. Based on the detection information of the lock sensor 43, when the control section 100 determines that the locking portion 40 provides the lock (a lock state), the control section 100 activates the elevating button 62, the back lifting and lowering button 63, and the knee lifting and lowering button 64 of the operating remote controller 61. Conversely, based on the detection information of the lock sensor 43, when the control section 100 determines that the locking portion 40 does not provide the lock (a non-lock state), the control section 100 deactivates the elevating button 62, the back lifting and lowering button 63, and the knee lifting and lowering button 64 of the operating remote controller 61.

With using the above configuration, in order to combine the wheelchair 9 and the bed main body portion 10, the wheelchair 9 in the flat posture is brought close to the bed main body portion 10 in the flat posture along the width direction of the bed main body portion 10 (refer to FIG. 2A). The chair base portion 13 of the wheelchair 9 is moved to and positioned in the recess portion 28 serving as the combination area provided on the side of the bed waist bottom member 17*b* between the bed back bottom support member 18*a* and the bed knee bottom support member 18*c*. At this time, the positioning sensor 51 provided in the bed base portion 19 in the innermost part of the recess portion 28 detects that the chair base portion 13 is moved to and rightly positioned in the recess portion 28, and the control section 100 determines that the chair base portion 13 is rightly positioned in the recess portion 28. When the chair base portion 13 is moved to and positioned in the recess portion 28, the seating bottom portion 15 and the bed bottom portion 17 are arranged side by side.

The chair base portion 13 is moved into the recess portion 28, the chair base portion 13 is positioned in the recess portion 28, and based on the information from the positioning sensor 51, the control section 100 determines that the chair base portion 13 is rightly positioned in the recess portion 28, and thereafter the bed 11 performs a switching action of the posture change mechanism by the support switching mechanism. Firstly, the elevating motor 27*m* of the elevating section 27 of the bed main body portion 10 is driven under the control of the control section 100 so as to raise the bed bottom support member 18 supported by the elevating section 27, so that height of the bed bottom support member 18 of the bed main body portion 10 is increased to the upper end position for the combination action. Then, the support member supporting the seating bottom portion 15 is switched from the chair bottom support member 14 to the bed bottom support member 18 by the support switching mechanism. That is, from a state where the seating bottom portion 15 is supported only by the chair bottom support member 14 through a state where the seating bottom portion 15 is supported by the chair bottom support member 14 and the bed bottom support member 18, when the bed bottom support member 18 is raised to the upper end position for the combination action, the seating bottom portion 15 is supported only by the bed bottom support member 18. As a result, the support member supporting the seating bottom portion 15 is switched from the chair bottom support member 14 to the bed bottom support member 18 by the support switching mechanism. The contact detection sensor 45 detects that the bed bottom support member 18 is raised to the upper end position for the combination action.

Figure 4B:
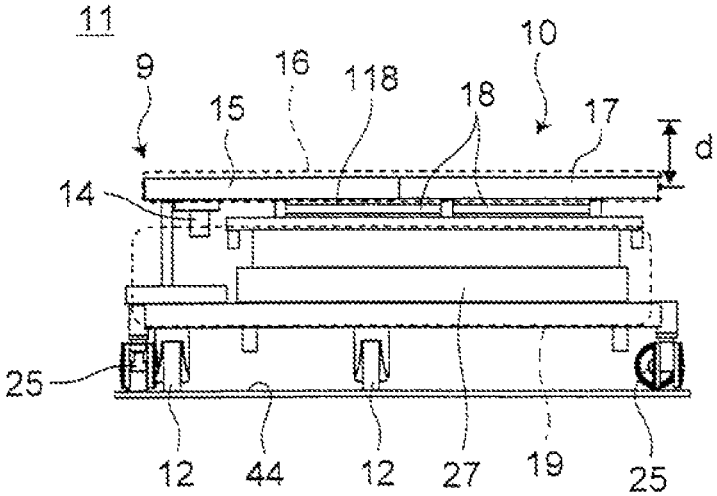
FIG. 4B is a front view of a state where the seating bottom portion is supported by a bed bottom support member in a state where the seating bottom portion is supported by the chair bottom support member in the first embodiment.

FIGS. 4A and 4B are front views in which the bed 11 during a switching action of the posture change mechanism is seen from the front side. FIG. 4A is a front view of a state where the seating bottom portion 15 is supported only by the chair bottom support member 14. FIG. 4B is a front view of a state where the seating bottom portion 15 is supported only by the bed bottom support member 18. With using FIGS. 4A and 4B, switching of a point supporting the seating bottom portion 15 from the chair bottom support member 14 to the bed bottom support member 18 by the support switching mechanism will be described in detail.

Firstly, when the wheelchair 9 and the bed main body portion 10 start the switching action of the posture change mechanism by the support switching mechanism, the posture change mechanism of the seating bottom portion 15 is switched from the chair bottom support member 14 to the bed bottom support member 18. In other words, the seating bottom portion 15 is disposed only on the bed bottom support member 18 and supported by the bed bottom support member 18. At this time, the seating bottom portion 15 is put on the protruding portions 118 of the bed bottom support member 18 protruding from the bed bottom portion 17 toward the side of the wheelchair 9 in the horizontal direction and supported by the protruding portions 118. A lower surface of the seating bottom portion 15 is supported by the protruding portions 118 of the bed bottom support member 18 in such a manner that the seating bottom portion 15 and the bed bottom portion 17 are integrated so as to compose the bed bottom portion 16. Parts of the bed bottom support member 18 other than the protruding portions 118 support a lower surface of the bed bottom portion 17.

Describing this based on the figures, firstly, as shown in FIG. 4A before switching, in a state where the seating bottom portion 15 is supported only by the chair bottom support member 14, the bed bottom support member 18 is placed under the seating bottom portion 15. At this time, the bed bottom portion 17 is lower than the seating bottom portion 15, and an upper surface of the bed bottom support member 18 supporting the bed bottom portion 17 is lower than an upper surface of the chair bottom support member 14 supporting the seating bottom portion 15. Therefore, the protruding portions 118 of the bed bottom support member 18 and the seating bottom portion 15 are away from each other, and the protruding portions 118 of the bed bottom support member 18 do not support the seating bottom portion 15.

By pressing the combining button 66, the elevating section 27 is driven under the control of the control section 100, so that the bed bottom support member 18 is raised from the lower end position for the separation action to the upper end position for the combination action. By raising the protruding portions 118 of the bed bottom support member 18 to a point where the protruding portions 118 are brought into contact with the seating bottom portion 15 (the upper end position for the combination action) as shown in FIG. 4B, the seating bottom portion 15 is supported by the protruding portions 118 of the bed bottom support member 18.

In such a way, the bed base portion 19 can raise and lower the bed bottom support member 18 between the upper end position for the combination action and the lower end position for the separation action by the elevating section 27 under the control of the control section 100. When the wheelchair 9 and the bed main body portion 10 start the switching action of the posture change mechanism by the support switching mechanism, the bed bottom support member 18 is raised by the elevating section 27 under the control of the control section 100, so that the bed bottom support member 18 placed under the seating bottom portion 15 is brought into contact with the lower surface of the seating bottom portion 15. Since the seating bottom portion 15 is brought into contact with the bed bottom support member 18 and supported by the bed bottom support member 18, the seating bottom portion 15 performs the posture change following the bed bottom support member 18. At this time, the seating bottom portion 15 does not follow an action of the chair bottom support member 14 and not perform the posture change by the chair bottom support member 14.

After that, by fixing the seating bottom portion 15 and the bed bottom support member 18 by the locking portion 40, the seating bottom portion 15 and the bed bottom portion 17 are integrated so as to compose the bed bottom portion 16. At this time, the height of the bed bottom portion 16 is the lowest state as the bed 11 at the time of the combination. In other words, the bed bottom portion 16 is at the lowest end of the bed elevating range d within which the bed 11 at the time of the combination can be moved up and down by actuating the elevating section 27. At this time, all the four traveling wheels 12 of the wheelchair 9 are in contact with the ground (or the installment surface of the wheelchair 9 and the bed main body portion 10) 44. In the bed 11 in which the wheelchair 9 and the bed main body portion 10 are combined, the seating bottom portion 15 and the bed bottom portion 17 can integrally perform the posture change as the nursing care bed. By actuating the elevating section 27 under the control of the control section 100, the height of the bed bottom portion 16 can be increased. In the case where by actuating the elevating section 27 under the control of the control section 100, the bed bottom portion 16 is raised within the bed elevating range d from a state where the bed bottom portion 16 shown in FIG. 4B is in the lowest end, all the traveling wheels 12 of the wheelchair 9 are brought up and are away from the ground (or the installment surface of the wheelchair 9 and the bed main body portion 10) 44.

It should be noted that in the case where a state where the seating bottom portion 15 is supported only by the protruding portions 118 of the bed bottom support member 18 shown in FIG. 4B is switched to a state where the seating bottom portion 15 is supported only by the chair bottom support member 14 shown in FIG. 4A by the support switching mechanism, by pressing the separating button 67, the height of the bed bottom support member 18 is decreased by the elevating section 27 under the control of the control section 100, so that the support member supporting the seating bottom portion 15 is switched from support only by the bed bottom support member 18 to support only by the chair bottom support member 14.

Figure 5:
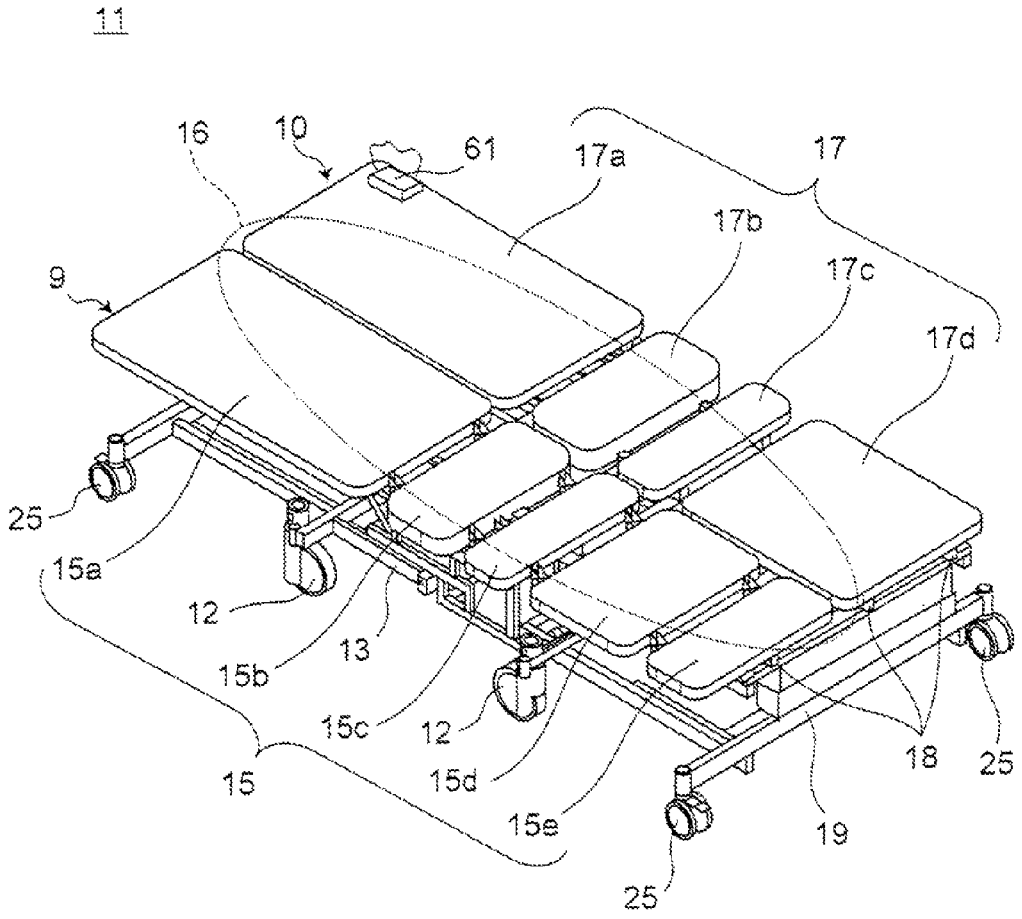
FIG. 5 is a perspective view of the bed at the time of the combination in the flat posture state in the first embodiment.

FIG. 5 is a perspective view of the bed 11 at the time of the combination in the flat posture. In the bed 11, the wheelchair 9 in the flat posture is combined with the bed main body portion 10 in the flat posture. Therefore, without getting out of the wheelchair 9, the care-receiver can get on the bed 11 while being in the wheelchair 9. Therefore, a physical burden on the caregiver can be reduced.

In the combined bed 11, the bed bottom portion 17 and the seating bottom portion 15 are integrated so as to form one flat bed bottom portion 16, and the posture change can be performed only by the bed bottom support member 18. The flat posture shown in FIG. 5 is changed to the back lifting posture by integrally lifting the chair back bottom member 15*a* and the bed back bottom member 17*a* by the back bottom support member 18*a*. The chair waist bottom member 15*b* and the bed waist bottom member 17*b* serve as one block. Further, the chair knee bottom member 15*c* and the bed knee bottom member 17*c* serve as one block, and the chair leg first bottom member 15*d*, the chair leg second bottom member 15*e*, and the bed leg bottom member 17*d* serve as one block. The knee lifting posture in which the two blocks are bent into an inverted V shape is composed of the knee bottom support member 18*c* and the leg bottom support member 18*d*.

Figure 6:
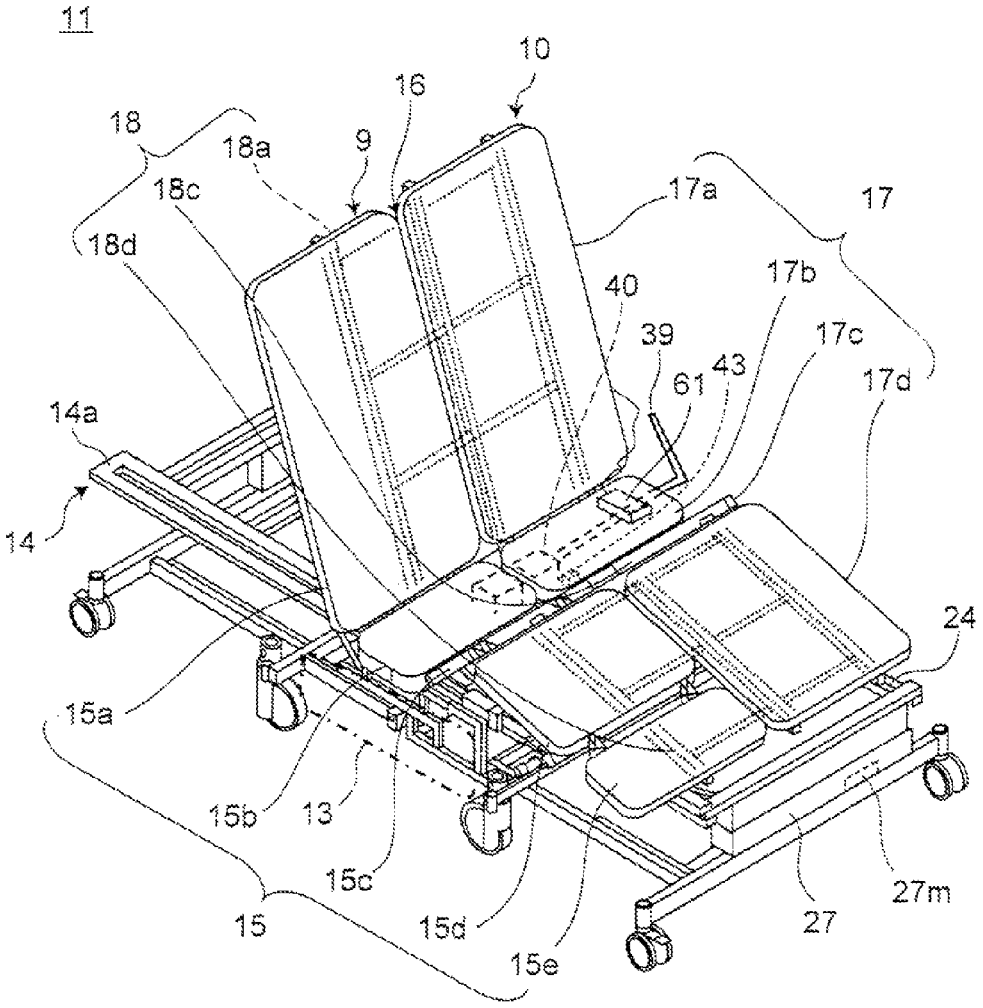
FIG. 6 is a perspective view of the bed in back lifting posture and knee lifting posture states in the first embodiment.

FIG. 6 is a perspective view of the bed 11 in back lifting posture and knee lifting posture states. FIGS. 7A and 7B are side views of the bed 11 in the back lifting posture and knee lifting posture states and in the bed lowering state and the bed raising state.

As shown in FIGS. 6, 7A, and 7B, the bed bottom portion 16 composed of the seating bottom portion 15 and the bed bottom portion 17 is made by coupling the plurality of divided members 15*a*, 15*b*, 15*c*, 15*d*, 17*a*, 17*b*, 17*c*, 17*d* so that the back lifting posture and the knee lifting posture can be formed. By lifting the back bottom support member 18*a* as a part of the bed bottom support member 18 and lifting and bending the knee bottom support member 18*c* and the leg bottom support member 18*d* as a part of the bed bottom support member 18 into an inverted V shape, the back lifting action and the knee lifting action as well as those with a general nursing care bed can be performed. At this time, by moving the coupling lever 39 so as to couple the seating bottom portion 15 and the bed bottom portion 17 by the locking portion 40, the seating bottom portion 15 and the bed bottom portion 17 are not displaced from each other.

When the wheelchair 9 and the bed main body portion 10 are combined, the posture change mechanism of the seating bottom portion 15 of the wheelchair 9 is switched from the chair bottom support member 14 to the bed bottom support member 18 by the support switching mechanism. Therefore, in the case where electric drive control is performed as the bed 11, there is no need for providing electric drive sections in the wheelchair 9. Even when there are no electric drive sections in the wheelchair 9, the bed 11 can be electrically driven. As a result, the wheelchair 9 can be simplified and weight thereof can be reduced.

When the knee bottom support member 18*c* and the leg bottom support member 18*d* are bent into an inverted V shape as shown in FIGS. 6, 7A, and 7B, the chair knee bottom member 15*c* and the chair leg first bottom member 15*d* are bent into an inverted V shape, and the bed knee bottom member 17*c* and the bed leg bottom member 17*d* are bent into an inverted V shape. Then, knee lifting is performed in the bed bottom portion 16. When the knee bottom support member 18*c* and the leg bottom support member 18*d* are in a flat surface, the chair knee bottom member 15*c*, the chair leg first bottom member 15*d*, the chair leg second bottom member 15*e*, the bed knee bottom member 17*c*, and the bed leg bottom member 17*d* are also in a flat surface.

It should be noted that in the longitudinal direction of the bed bottom portion 16, longitudinal dimension of the chair back bottom member 15*a* is equal to longitudinal dimension of the bed back bottom member 17*a*, longitudinal dimension of the chair waist bottom member 15*b* is equal to longitudinal dimension of the bed waist bottom member 17*b*, longitudinal dimension of the chair knee bottom member 15*c* is equal to longitudinal dimension of the bed knee bottom member 17*c*, and a total dimension of a longitudinal dimension of the chair leg first bottom member 15*d* and a longitudinal dimension of the chair leg second bottom member 15*e* is equal to a longitudinal dimension of the bed leg bottom member 17*d*. This is because the length is equalized so that the bed bottom portion 17 and the seating bottom portion 15 can integrally perform the posture change. In the width direction of the bed bottom portion 16, a total dimension of a width dimension of the chair back bottom member 15*a* and a width dimension of the bed back bottom member 17*a*, a total dimension of a width dimension of the chair waist bottom member 15*b* and a width dimension of the bed waist bottom member 17*b*, a total dimension of a width dimension of the chair knee bottom member 15*c* and a width dimension of the bed knee bottom member 17*c*, and a total dimension of a width dimension of the chair leg first bottom member 15*d* or a width dimension of the chair leg second bottom member 15*e* and the bed leg bottom member 17*d* are equal to each other. This is to make the members have the same width dimension as the bed bottom portion 16 so as to be treated as one bed surface.

Next, the combining method of the separated bed will be described.

Figure 8:
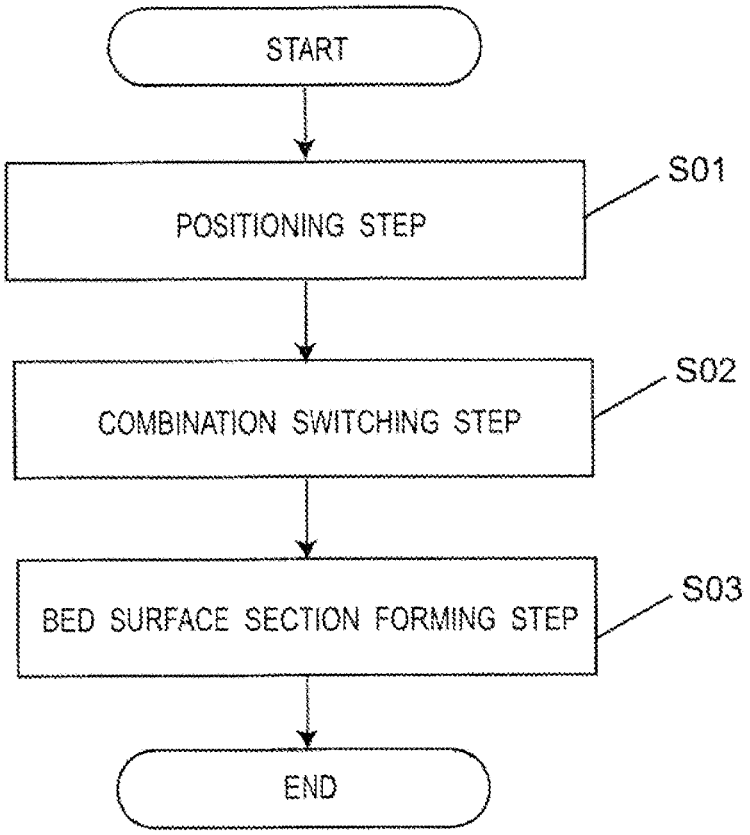
FIG. 8 is a flowchart of a combining method of the bed in the first embodiment.

FIG. 8 is a flowchart of the combining method of the bed 11. As shown in FIG. 8, in the combining method of the bed 11, firstly, positioning step S01 of detecting that the wheelchair 9 in the flat posture is moved to and rightly positioned in the recess portion 28 serving as the combination area of the bed main body portion 10.

In this positioning step S01, the caregiver manually moves the chair base portion 13 of the wheelchair 9 into the recess portion 28 of the bed main body portion 10. Thereafter, based on the detection information from the positioning sensor 51, the control section 100 determines whether or not the chair base portion is rightly positioned in the recess portion 28. When the control section 100 determines that the chair base portion 13 of the wheelchair 9 is rightly positioned in the recess portion 28 based on the detection information from the positioning sensor 51, the flow proceeds to combination switching step S02. When positioning of the wheelchair 9 is completed, the combining button 66 of the operating remote controller 61 shown in FIG. 9 is lit, and control by the combining button 66 is activated. Further, at this time, from the operating remote controller 61, the caregiver or the care-receiver can be audibly instructed to press the combining button 66 of the operating remote controller 61.

In the combination switching step S02, the posture change mechanism of the seating bottom portion 15 of the wheelchair 9 is switched from the chair bottom support member 14 provided in the wheelchair 9 to the bed bottom support member 18 provided in the bed main body portion 10 by the support switching mechanism. That is, switching of the posture change mechanism of the seating bottom portion 15 by the support switching mechanism indicates that by pressing the combining button 66, the bed bottom support member 18 is raised by driving the elevating section 27 via the control section 100, so that support of the seating bottom portion 15 is switched from the chair bottom support member 14 to the bed bottom support member 18. That is, when the caregiver or the care-receiver presses the combining button 66 of the operating remote controller 61, firstly, the elevating motor 27*m* of the elevating section 27 is driven and the bed bottom support member 18 is raised only while the combining button 66 is being pressed. When the bed bottom support member 18 comes to height where the bed bottom support member 18 is brought into contact with the lower surface of the seating bottom portion 15 (the upper end position for the combination action), in other words, when the contact detection sensor 45 detects that the bed bottom support member 18 supports the seating bottom portion 15, the control section 100 stops the elevating motor 27*m*, so that a raising action of the bed bottom support member 18 is stopped. Then, the seating bottom portion 15 is supported only by the bed bottom support member 18 from the lower side. Regarding the combining button 66, the bed bottom portion 16 is raised only while the combining button 66 is being pressed in consideration with safety. However, the bed bottom support member 18 may be automatically moved to the height where the bed bottom support member 18 is brought into contact with the lower surface of the seating bottom portion 15 once the combining button 66 is pressed. When the contact detection sensor 45 detects that the bed bottom support member 18 supports the seating bottom portion 15, the light of the combining button 66 is turned off. At this time, from the operating remote controller 61, the caregiver or the care-receiver can be audibly instructed to move the coupling lever 39. By moving the coupling lever 39, the seating bottom portion 15 and the bed bottom portion 17 are coupled to each other by the locking portion 40.

Further, after the combination switching step S02, bed bottom portion composing step S03 in which the caregiver or the care-receiver moves the coupling lever 39, and combines the seating bottom portion 15 and the bed bottom portion 17 of the bed main body portion 10 by the locking portion 40 so as to compose the bed bottom portion 16 is performed.

In such a way, by switching the posture change mechanism for performing the posture change of the seating bottom portion 15 by the support switching mechanism after positioning, the bed bottom support member 18 can support the seating bottom portion 15 without the position displacement.

Further, in the bed bottom portion composing step S03, the bed bottom portion 16 is composed, the lock sensor 43 detects that the locking portion 40 provides the lock, and the control section 100 determines that the locking portion 40 is in the lock state. After that, operations of the elevating button 62, the back lifting and lowering button 63, and the knee lifting and lowering button 64 of the operating remote controller 61 are activated by the control section 100, so that an instruction of performing the posture change by the bed bottom support member 18 can be provided by using the back lifting and lowering button 63 and the knee lifting and lowering button 64 of the operating remote controller 61. That is, controlling of the back lifting translation actuator 41*a* for driving the back bottom support member 18*a* and the knee lifting translation actuator 41*b* for driving the leg bottom support member 18*d* by the operating remote controller 61 is activated by the control section 100. By such a combining method, the wheelchair 9 and the bed main body portion 10 are combined.

In such a way, after completion of the switching action of the posture change mechanism by the support switching mechanism, the controlling of the back lifting translation actuator 41*a* and the knee lifting translation actuator 41*b* by the operating remote controller 61 is activated by the control section 100. Thus, during the switching action of the posture change mechanism, failure of the switching action of the posture change mechanism due to an erroneous operation of the operating remote controller 61 can be prevented. If the back lifting and lowering button 63 or the knee lifting and lowering button 64 of the operating remote controller 61 is touched by mistake during the switching action of the posture change mechanism, the bed bottom support member 18 is moved, so that unanticipated posture change is performed. Then, an operator (the caregiver or the care-receiver) becomes incapable of controlling. In order to prevent such a situation, the buttons of the operating remote controller 61 may be preferably controlled by the above control section 100.

Next, the separating method of the bed 11, which is a method for separating the wheelchair 9 and the bed main body portion 10 will be described.

Figure 10:
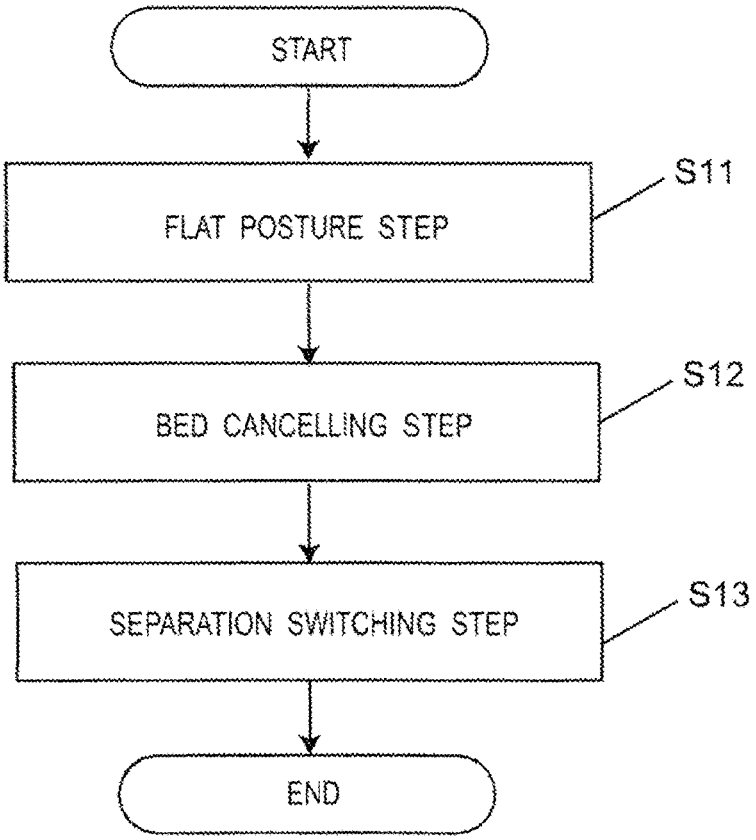
FIG. 10 is a flowchart of a separating method of the bed in the first embodiment.

FIG. 10 is a flowchart of the separating method of the bed 11. The separating method of the bed 11 has flat posture step S11 of bringing the bed bottom portion 16 of the bed 11 into the flat posture, bed canceling step S12 of canceling the locking portion 40 combining the seating bottom portion 15 and the bed bottom portion 17 relative to the seating bottom portion 15 and the bed bottom portion 17 composing the bed bottom portion 16 after the flat posture step S11, and separation switching step S13 of switching the point supporting the seating bottom portion 15 from the bed bottom support member 18 to the chair bottom support member 14 after the bed canceling step S12.

In such a way, by switching the point supporting the seating bottom portion 15 (in other words, the posture change mechanism) from the bed bottom support member 18 to the chair bottom support member 14 by the support switching mechanism after canceling the locking portion 40, safe separation can be performed.

Hereinafter, the separating method of the bed 11 will be described in detail.

Firstly, in the flat posture step S11, the back lifting and lowering button 63 and the knee lifting and lowering button 64 of the operating remote controller 61 are operated, so that the bed 11 at the time of the combination in the back lifting posture and the knee lifting posture is changed to the flat posture, and the elevating button 62 of the operating remote controller 61 is operated, so that the raised bed bottom portion 16 is lowered to the lowest end of the bed elevating range d. In a state where the bed bottom portion 16 is lowered to the lowest end of the bed elevating range d (in other words, in a state where the bed bottom portion is at the upper end position for the combination action), the back lifting and lowering button 63, the knee lifting and lowering button 64, and the separating button 67 of the operating remote controller 61 shown in FIG. 9 are respectively pressed, the bed 11 respectively performs the back lowering action, the knee lowering action, and the lowering action only while the back lifting and lowering button 63, the knee lifting and lowering button 64, and the separating button 67 are respectively being pressed. When the bed is changed to the flat posture and the bed bottom portion 16 is lowered from the upper end position for the combination action to the lower end position for the separation action, the control section 100 stops the action (step S11). It should be noted that instead of respectively pressing the back lifting and lowering button 63, the knee lifting and lowering button 64, and the separating button 67, by pressing only the separating button 67, the bed 11 may respectively perform the back lowering action, the knee lowering action, and the lowering action so as to be changed to the flat posture, and the bed bottom portion 16 may be lowered from the upper end position for the combination action to the lower end position for the separation action. The control section 100 can determine that the bed is changed to the flat posture based on the detection information from the first flat posture detection sensor 21 and the second flat posture detection sensor 22. The control section 100 can determine that the bed bottom portion 16 is lowered to the lower end position for the separation action based on detection information from a bed lower limit sensor 95 provided in the bed base portion 19.

When the back lifting and lowering button 63, the knee lifting and lowering button 64, and the separating button 67 are respectively pressed, so that the bed 11 is changed to the flat posture and the bed bottom portion 16 is moved to the lowest end of the bed elevating range d (in other words, the upper end position for the combination action), under the control of the control section 100, the operating remote controller 61 audibly notifies the caregiver or the care-receiver to move the coupling lever 39 so as to cancel the coupling of the locking portion 40.

The caregiver or the care-receiver manually moves the coupling lever 39 so as to cancel the coupling of the locking portion 40 coupling the seating bottom portion 15 and the bed bottom portion 17 (step S12). At this time, the lock sensor 43 detects that the locking portion 40 is cancelled, the detection information of the lock sensor 43 is inputted to the control section 100, and the control section 100 determines that the locking portion 40 is in the non-lock state.

Next, the caregiver presses the separating button 67 of the operating remote controller 61. At this time, the lock sensor 43 detects that the locking portion 40 is cancelled, and the control section 100 already determines that the locking portion 40 is in the non-lock state. Therefore, by pressing the separating button 67, the elevating section 27 is lowered, so that the bed bottom support member 18 is brought down to the lower side from the upper end position for the combination action to the lower end position for the separation action. From a state where the bed bottom support member 18 supports the seating bottom portion 15, the bed bottom support member 18 is brought downward away from the seating bottom portion 15. Then, the seating bottom portion 15 is supported only by the chair bottom support member 14. The operating remote controller 61 audibly notifies the caregiver that the wheelchair 9 can be separated from the bed main body portion 10 (step S13). It should be noted that when the control section 100 determines that the locking portion 40 is not cancelled (the locking portion 40 is in the lock state) from a detection result of the lock sensor 43, the control section 100 can also audibly notify the caregiver or the like to move the coupling lever 39 so as to cancel the coupling of the locking portion 40 from the speaker provided in the operating remote controller 61.

In such a way, by lowering the bed bottom support member 18 by the elevating section 27, the support of the seating bottom portion 15 is switched from the bed bottom support member 18 to the chair bottom support member 14 by the support switching mechanism. The caregiver manually pulls out the wheelchair 9 from the bed main body portion 10, and manually brings the wheelchair 9 into the seating posture. By such a separating method, the bed 11 can be separated.

It should be noted that in the bed canceling step S12, the operations by the operating remote controller 61 for providing the instructions to perform the posture change to the back lifting translation actuator 41*a* and the knee lifting translation actuator 41*b* of the bed bottom support member 18 may be deactivated. In such a way, during a separation operation, failure of the separation due to an erroneous operation of the operating remote controller 61 can be prevented.

Second Embodiment

Figure 11A:
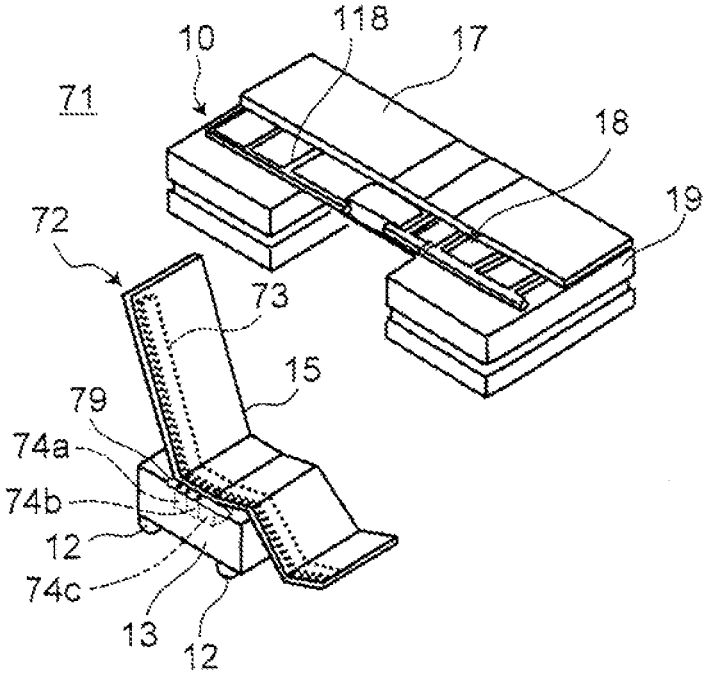
FIG. 11A is a schematic perspective view at the time of separation of a bed in a second embodiment of the present invention.
Figure 11B:
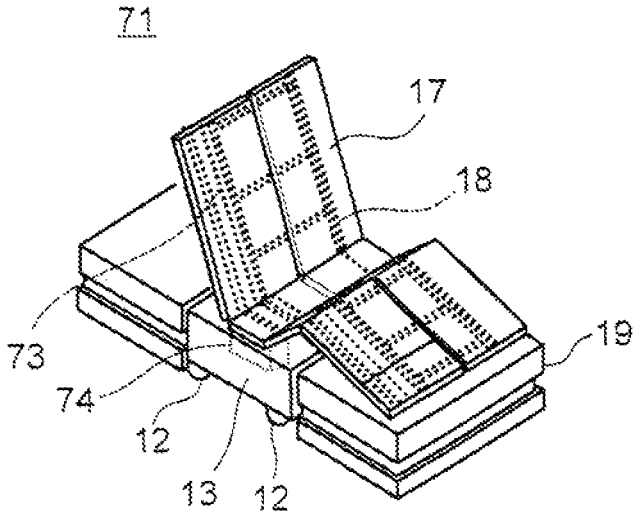
FIG. 11B is a schematic perspective view at the time of combination of the bed in the second embodiment of the present invention.
Figure 12:
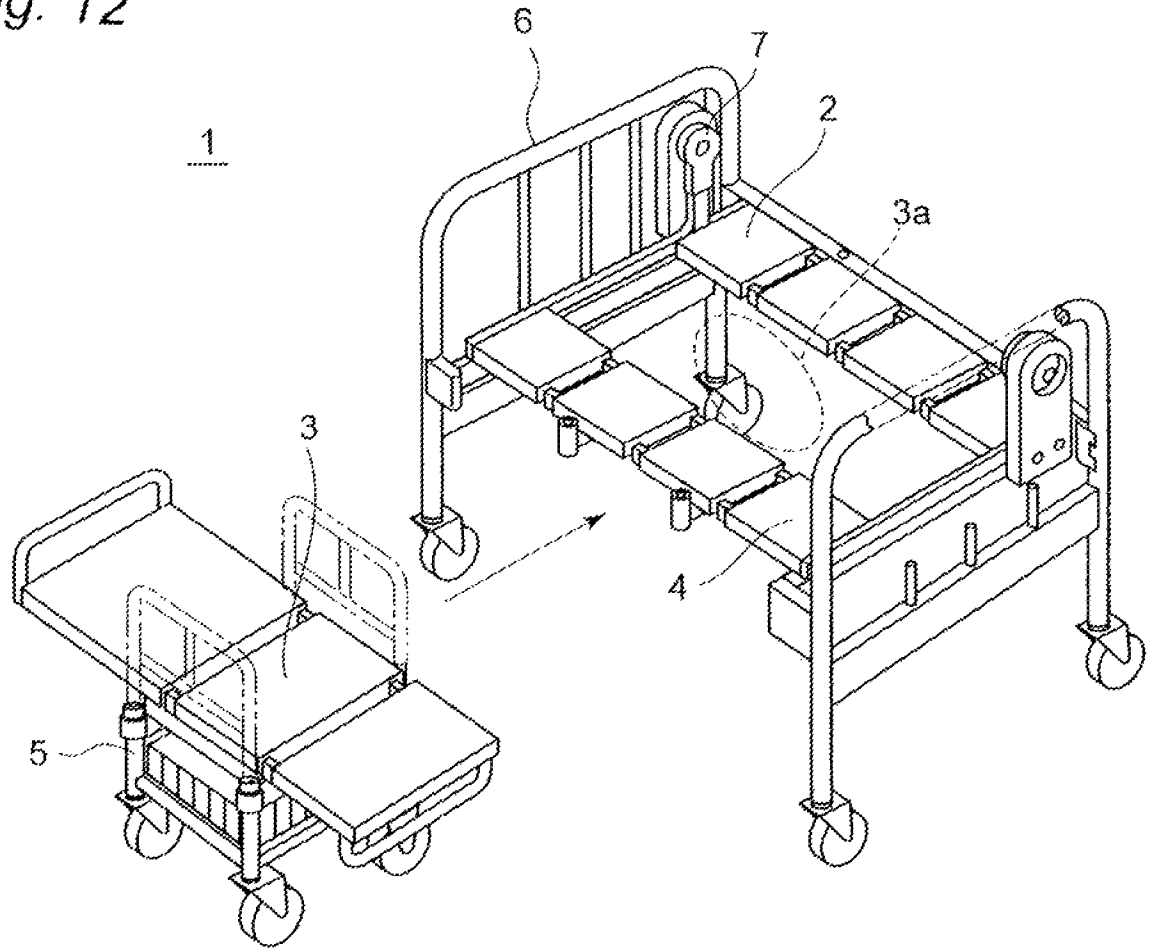
FIG. 12 is a perspective view of the bed with a conventional wheelchair serving as a part of the constituent of the bed.
Figure 13:
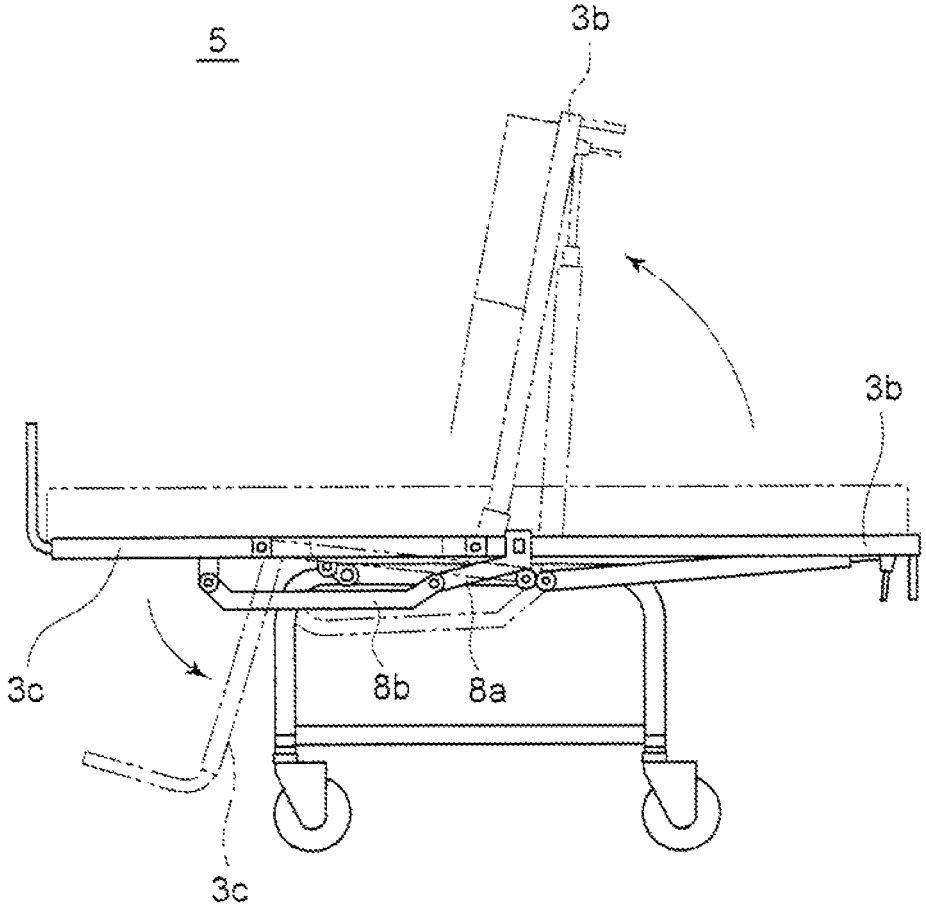
FIG. 13 is a perspective view of the conventional wheelchair.

FIGS. 11A and 11B are schematic perspective views of a bed 71 in a second embodiment of the present invention. FIG. 11A is a schematic perspective view at the time of the separation. FIG. 11B is a schematic perspective view at the time of the combination.

The bed 71 of the second embodiment is an electric nursing care bed in which the posture change is performed by the electric drive sections. A wheelchair 72 separated from the bed 71 is an electric reclining wheelchair in which the posture change is performed by electric drive sections. Description of similar configurations and functions to the first embodiment will be omitted, and only different points will be described below.

As shown in FIGS. 11A and 11B, the wheelchair 72 has a first chair electric drive section 74*a*, a second chair electric drive section 74*b*, and a third chair electric drive section 74*c* so as to respectively independently perform the back lifting action and the back lowering action, the knee lifting action and the knee lowering action, and a leg lifting action and a leg lowering action.

The first chair electric drive section 74*a* is arranged in a chair bottom support member 73 of the wheelchair 72, and driven under the control of the control section 100 so as to change the inclination of the chair back bottom member 15*a*.

The second chair electric drive section 74*b* is arranged in the chair bottom support member 73 of the wheelchair 72, and driven under the control of the control section 100 so as to change inclination of the chair knee bottom member 15*c*.

The third chair electric drive section 74*c* is arranged in the chair bottom support member 73 of the wheelchair 72, and driven under the control of the control section 100 so as to change inclinations of the chair leg first bottom member 15*d* and the chair leg second bottom member 15*e*.

The electric drive sections can be formed, for example, by translation actuators as well as those in the first embodiment.

By operating the first chair electric drive section 74*a*, the second chair electric drive section 74*b*, and the third chair electric drive section 74*c* by an operating remote controller 79 exclusive for the wheelchair and driving the electric drive sections under the control of the control section 100, the care-receiver can perform the back lifting action and the back lowering action, the knee lifting action and the knee lowering action, and the leg lifting action and the leg lowering action from his/her own motive.

In the bed 71, the posture change of the chair bottom support member 73 is realized by the first chair electric drive section 74*a*, the second chair electric drive section 74*b*, and the third chair electric drive section 74*c* via a freewheel structure which is frequently adopted in a general electric nursing care bed. Thus, the posture change of the seating bottom portion 15 can be switched from the chair bottom support member 73 provided in the wheelchair 72 to the bed bottom support member 18 provided in the bed main body portion 10 by the support switching mechanism. The freewheel structure indicates a structure in which an electrically actuated drive section does not provide restriction. As a specific example of the freewheel structure, the chair back bottom member 15*a* or the bed back bottom member 17*a* is not inseparably coupled to drive sections such as translation actuators, but arms driven by drive sections such as translation actuators to travel back and forth are separably brought into contact with a back surface of the chair back bottom member 15*a* or a back surface of the bed back bottom member 17*a* (for example, refer to a relationship between the arm 42*a* and the bed back bottom support member 18*a* or to a relationship between the arm 42*b* and the bed knee bottom support member 18*c* in FIG. 7A). By pressing the chair back bottom member 15*a* or the bed back bottom member 17*a* by the arm, the chair back bottom member 15*a* or the bed back bottom member 17*a* is changed from the flat posture to the seating posture. Meanwhile, by pulling the arm, the chair back bottom member 15*a* or the bed back bottom member 17*a* is changed from the seating posture to the flat posture by utilizing self-weight of the chair back bottom member 15*a* or the bed back bottom member 17*a*. The freewheel structure indicates such a structure. This freewheel structure can function as a force transmission switching mechanism for switching between the transmission and the blocking of the force for the posture change relative to the chair bottom support member 73.

In the case where the wheelchair 72 and the bed main body portion 10 are separated from each other, the first chair electric drive section 74*a*, the second chair electric drive section 74*b*, and the third chair electric drive section 74*c* are actuated so as to change the chair bottom support member 73 to an arbitrary posture. Here, the chair bottom support member 73 is a similar member to the chair bottom support member 14 of the first embodiment. However, a different point from the chair bottom support member 14 is that the chair bottom support member 73 can form the back lifting posture and the knee lifting posture integrally with the seating bottom portion 15 and the bed bottom portion 17 after the combination.

In the case where the wheelchair 72 and the bed main body portion 10 are combined, by the freewheel structure, the chair bottom support member 73 for changing the inclination of the seating bottom portion 15 is separated from the first chair electric drive section 74*a*, the second chair electric drive section 74*b*, and the third chair electric drive section 74*c*, and the inclination of the seating bottom portion 15 can be changed by the bed bottom support member 18. That is, in a state where the wheelchair 72 and the bed main body portion 10 are combined, the chair bottom support member 73 of the wheelchair 72 performs the posture change following the action of the seating bottom portion 15 of the wheelchair 72. When the transmission of the force for the posture change of the seating bottom portion 15 of the wheelchair 72 to the chair bottom support member 73 is blocked by the freewheel structure serving as one example of the force transmission switching mechanism, the seating bottom portion 15 of the wheelchair 72 is not supported by the chair bottom support member 73. The transmission of the force for the posture change of the seating bottom portion 15 indicates transmission of drive forces from the first chair electric drive section 74*a*, the second chair electric drive section 74*b*, and the third chair electric drive section 74*c*.

In such a way, by respectively actuating the chair bottom support member 73 by the first chair electric drive section 74*a*, the second chair electric drive section 74*b*, and the third chair electric drive section 74*c* via the freewheel structure, the support member supporting the seating bottom portion 15 can be switched from the chair bottom support member 73 to the bed bottom support member 18 by the support switching mechanism.

It should be noted that in the wheelchair 72, the postures of the chair knee bottom member 15*c*, the chair leg first bottom member 15*d*, and the chair leg second bottom member 15*e* relative to leg surface parts may be changed in conjunction with the action of the chair back bottom member 15*a*. In this case, the posture change of the wheelchair 72 can be performed by a single chair electric drive section. Thus, the wheelchair 72 can be formed in a simple configuration and the weight thereof can be reduced. In the above description, the chair bottom support member 73 and the chair electric drive sections 74*a* to 74*c* are separated by the freewheel structure. However, the chair electric drive sections 74*a* to 74*c* may be freed by a clutch or the like.

It should be noted that in the case where the wheelchair 9, 72 has a tilt mechanism which is often adopted in a general wheelchair in the first and the second embodiments, the wheelchair may be combined with or separated from the bed main body portion 10 in an inclined state by utilizing the tilt mechanism.

It should be noted that by appropriately combining arbitrary embodiments or modification examples among the above various embodiments or modification examples, effects provided in embodiments and the modification examples can be obtained.

INDUSTRIAL APPLICABILITY

With the bed of the present invention, there is no need for transferring itself between the bed and the wheelchair which is necessary in a conventional example. The caregiver can transfer the care-receiver from the bed to the wheelchair and from the wheelchair to the bed without taking up the care-receiver. Therefore, the bed is useful in an ordinary house, a hospital facility, and a nursing care facility where a person in need of care resides.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A bed, comprising:

a support switching mechanism, the bed being composed of separably combining a wheelchair and a bed main body portion in a width direction of the bed main body portion, the wheelchair comprising:

a seating bottom portion composed of bendably coupling a plurality of divided members to each other; and a chair bottom support member supporting the seating bottom portion, the bed main body portion comprising:

a bed bottom portion composed of bendably coupling a plurality of divided members to each other; and a bed bottom support member supporting the bed bottom portion, the bed bottom support member having a protruding portion protruding from the bed bottom portion in the width direction of the bed main body portion, the protruding portion being positioned on a lower side of the seating bottom portion of the wheelchair and arranged so as to be capable of supporting the seating bottom portion of the wheelchair in a state where the wheelchair and the bed main body portion are combined, and the support switching mechanism switching a support member that supports the seating bottom portion of the wheelchair from the lower side of the seating bottom portion of the wheelchair, from the chair bottom support member to the bed bottom support member only, in the state where the wheelchair and the bed main body portion are combined.

2. The bed according to claim 1, wherein the protruding portion supports a chair back bottom member and a chair leg bottom member of the seating bottom portion of the wheelchair from the lower side thereof in the state where the wheelchair and the bed main body portion are combined.

3. The bed according to claim 1, wherein the support switching mechanism switches the support member so that the seating bottom portion of the wheelchair is supported by the chair bottom support member in a state where the wheelchair and the bed main body portion are separated, and the seating bottom portion of the wheelchair is supported only by the bed bottom support member from the lower side of the seating bottom portion of the wheelchair and is separated from the chair bottom support member in the state where the wheelchair and the bed main body portion are combined.

4. The bed according to claim 1, wherein:

the bed main body portion comprises an elevating machine that raises and lowers the bed bottom support member, the elevating machine raises and lowers the bed bottom support member so as to raise and lower both the bed bottom portion and the seating bottom portion in a state where the bed bottom support member and the seating bottom portion of the wheelchair are in contact with each other, and the elevating machine raises and lowers the bed bottom support member so as to raise and lower only the bed bottom portion in a state where the bed bottom support member and the seating bottom portion of the wheelchair are away from each other.

5. The bed according to claim 1, wherein the support switching mechanism switches so that the seating bottom portion of the wheelchair does not follow a posture change of the chair bottom support member in the state where the wheelchair and the bed main body portion are combined.

6. The bed according to claim 1, further comprising:

a force transmission switching mechanism that switches between transmission and blocking of force for posture change of the seating bottom portion of the wheelchair relative to the chair bottom support member, wherein:

the force transmission switching mechanism transmits the force for the posture change of the seating bottom portion of the wheelchair to the chair bottom support member in a state where the wheelchair and the bed main body portion are separated, and the chair bottom support member of the wheelchair performs the posture change following an action of the seating bottom portion of the wheelchair in the state where the wheelchair and the bed main body portion are combined, and when the transmission of the force for the posture change of the seating bottom portion of the wheelchair to the chair bottom support member is blocked by the force transmission switching mechanism, the seating bottom portion of the wheelchair is not supported by the chair bottom support member.

7. The bed according to claim 1, wherein:

the bed bottom support member has a bed back bottom support member, a bed knee bottom support member, and a bed leg bottom support member, respectively bendably coupled to each other, the seating bottom portion has a chair back bottom member, a chair waist bottom member, a chair knee bottom member, a chair first leg bottom member, and a chair second leg bottom member, respectively bendably coupled to each other, the bed bottom portion has a bed back bottom member, a bed waist bottom member, a bed knee bottom member, and a bed leg bottom member, respectively bendably coupled to each other, and the support switching mechanism switches so that, in the state where the wheelchair and the bed main body portion are combined, a back bottom support member supports the chair back bottom member and the bed back bottom member, a knee bottom support member supports the chair knee bottom member and the bed knee bottom member, and a leg bottom support member supports the chair first leg bottom member, the chair second leg bottom member, and the bed leg bottom member.

8. The bed according to claim 1, wherein:

the chair bottom support member has a chair back bottom support member, a chair knee bottom support member, a chair first leg bottom support member, and a chair second leg bottom support member, and the chair knee bottom support member and the chair first leg bottom support member are moved in conjunction with movement of the chair back bottom support member in a state where the seating bottom portion is supported by the chair bottom support member.

9. A combining method of a bed comprising a support switching mechanism, the combining method for separably combining a wheelchair and a bed main body portion in a width direction of the bed main body portion, wherein:

the wheelchair comprises: a seating bottom portion composed of bendably coupling a plurality of divided members to each other; and a chair bottom support member supporting the seating bottom portion, and the bed main body portion comprises: a bed bottom portion composed of bendably coupling a plurality of divided members to each other; and a bed bottom support member supporting the bed bottom portion, a protruding portion protruding from the bed bottom support member in the width direction of the bed main body portion is positioned on a lower side of the seating bottom portion of the wheelchair and arranged so as to be capable of supporting the seating bottom portion of the wheelchair, in a state where the wheelchair and the bed main body portion are combined, the combining method comprising: in the state where the wheelchair and the bed main body portion are combined, positioning the protruding portion of the bed bottom support member on the lower side of the seating bottom portion of the wheelchair; and switching a support member supporting the seating bottom portion of the wheelchair from the lower side of the seating bottom portion of the wheelchair, from the chair bottom support member to the bed bottom support member only, by the support switching mechanism.

10. The combining method of the bed according to claim 9, further comprising supporting, by the protruding portion, a chair back bottom member and a chair leg bottom member of the seating bottom portion of the wheelchair from the lower side thereof in the state where the wheelchair and the bed main body portion are combined.

11. The combining method of the bed according to claim 9, further comprising: combining the wheelchair and the bed main body portion, detecting via a sensor whether or not a chair base portion supporting the chair bottom support member of the wheelchair is in a combination area formed as a space in an intermediate part of the bed main body portion.

12. The combining method of the bed according to claim 9, further comprising:

raising the bed bottom support member and the bed bottom portion;

combining the wheelchair and the bed main body portion; and thereafter, connecting the seating bottom portion of the wheelchair and the bed bottom portion of the bed main body portion by a locking portion so as to compose a bed bottom portion in which the seating bottom portion and the bed bottom portion are integrated.

13. The combining method of the bed according to claim 9, further comprising: at a time of switching the support member supporting the seating bottom portion of the wheelchair from the lower side of the seating bottom portion of the wheelchair, from the chair bottom support member to the bed bottom support member only, raising the bed bottom support member; and supporting the seating bottom portion from the lower side thereof, so that support of the seating bottom portion is switched to the bed bottom support member.

14. The combining method of the bed according to claim 12, comprising: activating a posture change of the bed bottom support member after the bed bottom portion is formed.

15. A separating method of a bed for separating a wheelchair and a bed main body portion combinably in a width direction of the bed main body portion, wherein:

the wheelchair comprises: a seating bottom portion composed of bendably coupling a plurality of divided members to each other; and a chair bottom support member supporting the seating bottom portion, and the bed main body portion comprises: a bed bottom portion composed of bendably coupling a plurality of divided members to each other; and a bed bottom support member supporting the bed bottom portion, the method comprising:

positioning a protruding portion protruding from the bed bottom support member in the width direction of the bed main body portion, on a lower side of the seating bottom portion of the wheelchair and then arranging the protruding portion so as to be capable of supporting the seating bottom portion of the wheelchair, in a state where the wheelchair and the bed main body portion are combined;

supporting the seating bottom portion of the wheelchair from the lower side thereof, by the bed bottom support member only, in the state where the wheelchair and the bed main body portion are combined; and the separating method comprising: switching a support member supporting the seating bottom portion of the wheelchair from the bed bottom support member to the chair bottom support member in a case where the wheelchair and the bed main body portion are separated.

16. The separating method of the bed according to claim 15, further comprising: supporting, by the protruding portion, a chair back bottom member and a chair leg bottom member of the seating bottom portion of the wheelchair from the lower side thereof in the state where the wheelchair and the bed main body portion are combined.

17. The separating method of the bed according to claim 15, further comprising:

in a case where switching the support member supporting the seating bottom portion of the wheelchair from the bed bottom support member to the chair bottom support member is performed, moving downward the bed bottom support member to a lower end position of separation operation, and then switching the support member supporting the seating bottom portion of the wheelchair from the bed bottom support member to the chair bottom support member.

18. The separating method of the bed according to claim 15, further comprising: after moving downward the bed bottom support member and the seating bottom portion and separating the wheelchair from the bed main body portion, a posture change of the bed bottom support member is disabled.

* * * * *